US009623993B2

(12) United States Patent
Loevenich

(10) Patent No.: US 9,623,993 B2
(45) Date of Patent: Apr. 18, 2017

(54) METHOD AND APPARATUS FOR TAPING CONTAINERS

(71) Applicant: The Procter & Gamble Company, Cincinnati, OH (US)

(72) Inventor: Franz Loevenich, Mechernich (DE)

(73) Assignee: The Procter & Gamble Company, Cincinnati, OH (US)

( * ) Notice: Subject to any disclaimer, the term of this patent is extended or adjusted under 35 U.S.C. 154(b) by 789 days.

(21) Appl. No.: 13/781,802

(22) Filed: Mar. 1, 2013

(65) Prior Publication Data

US 2014/0245702 A1 Sep. 4, 2014

(51) Int. Cl.
*B65B 51/06* (2006.01)

(52) U.S. Cl.
CPC ..... *B65B 51/067* (2013.01); *B31B 2201/29* (2013.01); *B31B 2201/6078* (2013.01); *B65B 2210/04* (2013.01); *B65B 2220/18* (2013.01)

(58) Field of Classification Search
CPC ..... B65B 51/06; B65B 51/067
See application file for complete search history.

(56) References Cited

U.S. PATENT DOCUMENTS 3,212,950 A * 10/1965 Philippi ..... B31B 3/00 156/351
3,954,550 A * 5/1976 Patterson ..... B65B 51/067 156/486
4,227,955 A 10/1980 Woods et al.
4,846,921 A * 7/1989 Lerner ..... B65B 51/06 156/352
5,730,831 A * 3/1998 Jensen, Jr. ..... B65B 51/067 156/468
5,982,031 A 11/1999 Stockmeier
2002/0057300 A1* 5/2002 Baker ..... B65B 51/067 347/2
2004/0124235 A1* 7/2004 White ..... B65B 51/067 229/125.34

(Continued)

FOREIGN PATENT DOCUMENTS

| | | |
|---|---|---|
| CA | 2 515 185 | 5/2004 |
| CA | 2 467 009 | 9/2004 |
| EP | 0 274 175 | 7/1988 |

(Continued)

OTHER PUBLICATIONS

PCT/US2014/018309 PCT International Search Report.

*Primary Examiner* — Hemant M Desai
*Assistant Examiner* — Tanzim Imam
(74) *Attorney, Agent, or Firm* — Sarah M. DeCristofaro; Abbey A. Lopez

(57) ABSTRACT

A taping apparatus includes a support arm movable in a first direction and a second direction. The first direction is opposite the second direction. The taping member is movably connected with the support arm. The taping member is movable in a third direction and a fourth direction. The third direction is opposite the fourth direction. The taping member includes a first guide member, a second guide member, and a cutting member positioned between the first guide member and the second guide member. The support arm is movably connected with a track that is rotatable from a first position to a second position. The taping apparatus is configured to tape containers of various dimensions and orientations.

3 Claims, 18 Drawing Sheets

(56) References Cited

U.S. PATENT DOCUMENTS

| | | | | |
|---|---|---|---|---|
| 2005/0019081 | A1 | 1/2005 | Baker et al. | |
| 2011/0239596 | A1 * | 10/2011 | Thomas | B65B 61/02 53/476 |

FOREIGN PATENT DOCUMENTS

| | | | | |
|---|---|---|---|---|
| EP | 0 850 839 | | 7/1998 | |
| JP | S 49-11260 | | 1/1974 | |
| JP | S 55-20120 | | 2/1980 | |
| JP | S 61-127426 | | 6/1986 | |
| JP | H 07-285521 | | 10/1995 | |
| JP | S 58-07530 | | 11/2015 | |
| KR | 2010/0120938 | A | 11/2010 | |
| NZ | WO 2009120096 | A1 * | 10/2009 | B65B 51/067 |
| WO | WO 97/31825 | A1 | 9/1997 | |
| WO | WO 2009/120096 | A1 | 10/2009 | |

* cited by examiner

METHOD AND APPARATUS FOR TAPING CONTAINERS

FIELD OF THE INVENTION

The present disclosure relates to methods and apparatuses for packaging consumer goods, and more particularly, to methods and apparatuses for taping containers for containing consumer goods such as absorbent articles.

BACKGROUND OF THE INVENTION

In some processes, fully assembled absorbent articles are packaged in containers for shipment and distribution to customers. Typically, the absorbent articles are packaged in primary packaging, for example, polybags, which are then placed into secondary packaging such as cardboard containers. The manufacturer may provide printed indicia on either or both of the primary packaging and secondary packaging, depending on which is intended to be the product ultimately purchased by a consumer. The cardboard container may be shipped to a retailer and placed on shelf, then a consumer purchases the container, takes it home, and then opens the container and disposes of it. Alternately, the consumer may purchase the container via e-commerce, for example, online through the internet, and the container is shipped directly to the consumer. In yet another alternative, the retailer may open the container and place the individual polybags of absorbent articles on a shelf for sale, and likely stack them to save space and/or to create a display. After taking the product home, the consumer typically opens the container, if any, and then opens the polybag containing the absorbent articles, removes all or some of the absorbent articles and then places them in yet another container such as a diaper bag or similar container attached or placed proximately to a changing table, from which they are retrieved at the point of use.

In some packaging operations, containers for containing absorbent articles are advanced through a taping apparatus to seal the open end or ends of the container. The taping apparatus may operate to continuously apply tape to the end of the container as the container advances through the taping apparatus. Such taping apparatuses may be configured to tape containers of a predetermined size and orientation. However, polybags of absorbent articles may vary in size as different size absorbent articles and/or different quantities of absorbent articles may be packaged in a polybag. As such, containers for containing absorbent articles may also vary in size. Also, in some processes, containers may be arranged in different orientations in a packaging process. In order to tape containers of different sizes or orientations, separate taping apparatuses configured for predetermined container sizes and orientations may be needed for each container size and orientation. Consequently, taping containers of different sizes and orientations may add cost and complexity to the absorbent article manufacturing process.

Therefore, it would be desirable to provide a method and apparatus for taping containers of various sizes and orientations.

SUMMARY OF THE INVENTION

Aspects of the present disclosure include a method for taping a container for containing absorbent articles. The container comprises first and second opposing side walls and third and fourth opposing side walls connected with the first and second side walls. The container comprises a first end flap and a second end flap. The first and second end flaps each include a proximal region and a distal region. The proximal region of the first end flap is pivotally connected with the first side wall and the proximal region of the second end flap is pivotally connected with the second side wall. The method comprises the step of: advancing a container in a machine direction to a taping apparatus, the taping apparatus comprising a taping member; stopping the container from advancing in machine direction adjacent to the taping member; applying a continuous length of tape from the taping member to the third side wall of the container while the container is stopped by moving the taping member in a first direction adjacent to the third side wall of the container, wherein the first direction is orthogonal to the machine direction; and applying the continuous length of tape from the taping member to the distal regions of the first and second end flaps while the container is stopped by moving the taping member in a second direction adjacent to the distal regions of the first and second end flaps of the container, wherein the second direction is orthogonal to the first direction.

Aspects of the present disclosure also include a method of taping containers in multiple orientations. The method comprises the steps of: advancing a first container in a machine direction to a taping apparatus, wherein the first container comprises first and second opposing side walls; third and fourth opposing side walls connected with the first and second side walls; a first end flap; and a second end flap, wherein the first and second end flaps each include a proximal region and a distal region, wherein the proximal region of the first end flap is pivotally connected with the first side wall and the proximal region of the second end flap is pivotally connected with the second side wall, wherein a slit extends in a first direction between the first end flap and the second end flap, wherein the taping apparatus comprises a taping member; stopping the first container from advancing in the machine direction; applying a continuous length of tape from the taping member to the distal regions of the first and second end flaps of the first container while the first container is stopped by moving the taping member in the first direction adjacent to the first and second end flaps of the first container; advancing the first container in the machine direction away from the taping apparatus; advancing a second container in the machine direction to the taping apparatus, wherein the second container comprises first and second opposing side walls; third and fourth opposing side walls connected with the first and second side walls; a first end flap; and a second end flap, wherein the first and second end flaps each include a proximal region and a distal region, wherein the proximal region of the first end flap is pivotally connected with the first side wall and the proximal region of the second end flap is pivotally connected with the second side wall, wherein a slit extends in a second direction between the first end flap and the second end flap, wherein the second direction is orthogonal to the first direction; stopping the second container from advancing in the machine direction; and applying the continuous length of tape from the taping member to the distal regions of the first and second end flaps of the second container while the second container is stopped by moving the taping member in the second direction adjacent to the first and second end flaps of the second container.

Aspects of the present disclosure include a taping apparatus for applying a continuous length of tape to a container for containing absorbent articles. The continuous length of tape has a first surface and an opposing second surface, wherein the second surface comprises an adhesive. The apparatus comprises a support arm movable in a first direction and a second direction, wherein the first direction is opposite the second direction. The apparatus comprises a taping member movably connected with the support arm. The taping member is movable in a third direction and a fourth direction, wherein the third direction is opposite the fourth direction. The third and fourth directions are orthogonal to the first and second directions. The taping member comprises a first guide member having an outer surface. The outer surface of the first guide member is adapted to receive the first surface of the continuous length of tape. The taping member comprises a second guide member having an outer surface. The outer surface of the second guide member is adapted to receive the first surface of the continuous length of tape. The second guide member is positioned such that the continuous length of tape advances from the first guide member to the second guide member. The taping member comprises a cutting member positioned between the first guide member and the second guide member. The cutting member is configured to cut the continuous length of tape between the first and second guide members.

DETAILED DESCRIPTION OF THE INVENTION

Figure 1A:
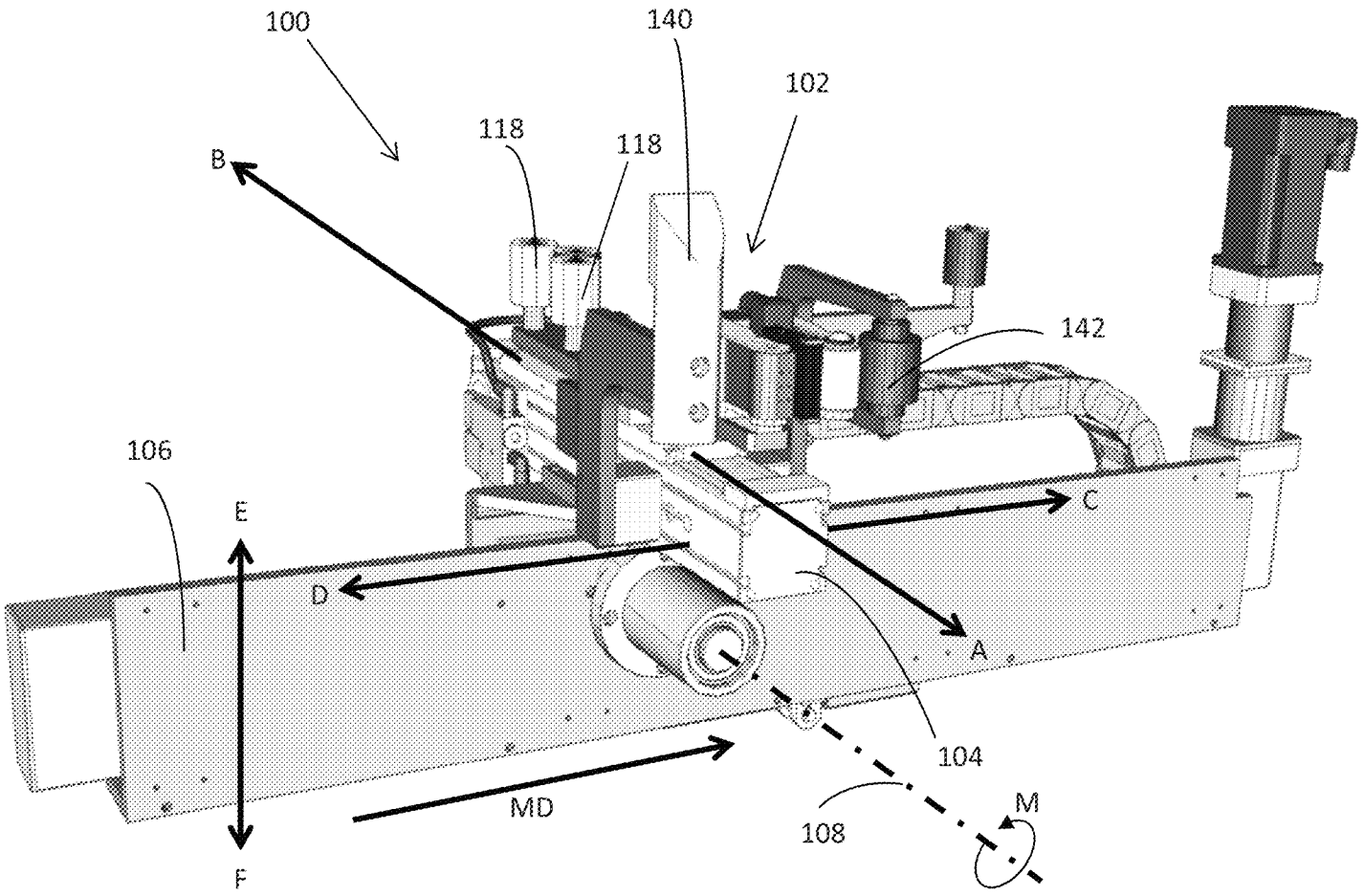
FIG. 1A is a front, perspective view of a taping apparatus in a first configuration.

The following definitions may be useful in understanding the present disclosure.

"Absorbent article" is used herein to refer to consumer products whose primary function is to absorb and retain soils and wastes. Absorbent articles may include disposable diapers, pads, and the like. "Diaper" is used herein to refer to an absorbent article generally worn by infants and incontinent persons about the lower torso of the wearer.

"Resilient" refers herein to the ability of a component to return to the component's original size and shape after deformation caused by the application of a compressive force to the component.

"Machine direction" (MD) refers herein to the direction of material flow through a process. In addition, relative placement and movement of material can be described as flowing in the machine direction through a process from upstream in the process to downstream in the process.

"Cross direction" (CD) refers herein to a direction that is not parallel with, and usually perpendicular to, the machine direction.

The present disclosure relates to methods and apparatuses for taping a container for containing absorbent articles, and more particularly, for taping containers having different dimensions and orientations. A container may include first and second opposing side walls and third and fourth opposing side walls connected with the first and second side walls. The container may comprise a first end flap and a second end flap. The first and second end flaps each include a proximal region and a distal region. The proximal region of the first end flap is pivotally connected with the first side wall and the proximal region of the second end flap is pivotally connected with the second side wall. The container may include a slit extending between the distal regions of the first end flap and the second end flap.

In an exemplary configuration, a first container may advance in a machine direction to a taping apparatus. The first container may be oriented in a first orientation such that the slit of the first container extends in a first direction that is parallel with the machine direction. In such an exemplary configuration, the taping apparatus may be configured to apply a single, discrete length of tape to the first container. The discrete length of tape may extend from the third side wall of the first container, along the distal regions of the first and second end flaps, and along the fourth side wall. In another exemplary configuration, the taping apparatus may be configured to intermittently apply first and second discrete lengths of tape to the first container. For example, in such an exemplary configuration, the first discrete length of tape may extend from the third side wall of the first container and along a portion of the distal regions of the first and second end flaps. The second discrete length of tape may extend from the distal regions of the first and second end flaps along the fourth side wall. The first discrete length of tape and the second discrete length of tape may be separated from each other.

In another exemplary configuration, a second container may advance in a machine direction to the taping apparatus. The second container may be oriented in a second orientation such that the slit of the second container extends in a second direction that is orthogonal to the machine direction. In such an exemplary configuration, the taping apparatus may be configured to apply a single, discrete length of tape, or two or more discrete lengths of tape to the second container. In an exemplary configuration, a single discrete length of tape may extend from the third side wall of the second container, along the distal regions of the first and second end flaps, and along the fourth side wall. In another exemplary configuration, a first discrete length of tape may extend from the third side wall of the second container and may extend along a portion of the distal regions of the first and second end flaps. In such a configuration, a second discrete length of tape may extend from the distal regions of the first and second end flaps and along the fourth side wall.

An exemplary taping apparatus includes a track and a support arm movably connected with the track. The taping apparatus also comprises a taping member movably connected with the support arm. In order to tape containers advancing in different orientations, the track may be adapted to rotate from a first position to a second position. With the track in the first position, the taping apparatus may be configured in a first configuration and may be adapted to tape a container oriented in the first orientation. With the track in the second position, the taping apparatus may be configured in a second configuration and may be adapted to tape a container oriented in the second orientation. When the taping apparatus is in the first configuration, the support arm is movable in a first direction and second direction on the track, wherein the first direction is opposite the second direction. Moreover, with the taping apparatus in the first configuration, the taping member is movable in a third direction and a fourth direction, wherein the third direction is opposite the fourth direction and the third and fourth directions are orthogonal to the first and second directions. When the taping apparatus is in the second configuration, the support arm is movable in a fifth direction and a sixth direction on the track, wherein the fifth direction is opposite the sixth direction and the fifth and sixth directions are orthogonal to the first and second directions. Also, with the taping apparatus in the second configuration, the taping member is movable in a seventh direction and an eighth direction, wherein the seventh direction is opposite the eighth direction, and wherein the seventh and eighth directions are parallel with the third and fourth directions.

The taping member may be configured to receive a continuous length of tape. A continuous length of tape may have a first surface and an opposing second surface. The second surface of the continuous length of tape may comprise an adhesive. Exemplary tape for taping containers according to the present disclosure is manufactured by the 3M Corporation of Milwaukee, Wis., under the designation SCOTCH® Box Sealing Tape 373. It is to be appreciated that different tape of various materials and sizes may be used with the taping apparatus of the present disclosure.

The taping member may comprise a first guide member having an outer surface. The outer surface of the first guide member may be adapted to receive the first surface of the continuous length of tape. The taping member may also comprise a second guide member having an outer surface. The outer surface of the second guide member may also be adapted to receive the first surface of the continuous length of tape. The second guide member may be positioned such that the continuous length of tape advances from the first guide member to the second guide member. The taping member may also comprise a cutting member positioned between the first guide member and the second guide member. The cutting member may be configured to cut the continuous length of tape that is positioned between the first and second guide members. In some exemplary configurations, the outer surface of the first guide member may comprise a plurality of vacuum apertures that are configured to apply vacuum to hold the continuous length of tape on the first guide member.

The taping apparatus may also comprise a third guide member located adjacent to the first guide member of the taping member. The third guide member may be configured to guide the first and second end flaps of the container to a fully closed configuration. The taping apparatus may also comprise a resilient guide member positioned adjacent to the second guide member of the taping member. The resilient guide member may be configured to press the second surface of the tape into contact with the container.

The taping apparatus may also be adapted to tape containers of various dimensions. For example, with the taping apparatus in the first configuration, the track may be movable in a ninth direction and a tenth direction. The ninth direction is opposite the tenth direction and the ninth and tenth directions are orthogonal to the first, second, third, and fourth directions. With the track in the second position, the track is movable in an eleventh direction and a twelfth direction. The eleventh direction is opposite the twelfth direction, and the eleventh and twelfth directions are orthogonal to the fifth, sixth, seventh, and eighth directions.

The taping member may be small in size compared to the container the taping member is taping. As such, with the range of motion of the taping apparatus and the small size of the taping member, the taping apparatus may be configured to tape containers at relatively high speeds. For example, the taping apparatus may be configured to tape up to 30 containers per minute.

While the present disclosure discusses a taping apparatus for taping containers for containing absorbent articles, it is to be appreciated that the methods and apparatuses disclosed herein may be used to tape containers for containing various other consumer products such as paper towel, toilet paper, wipes, cosmetics, detergents, skin care products, pharmaceutical products, and the like.

Figure 2:
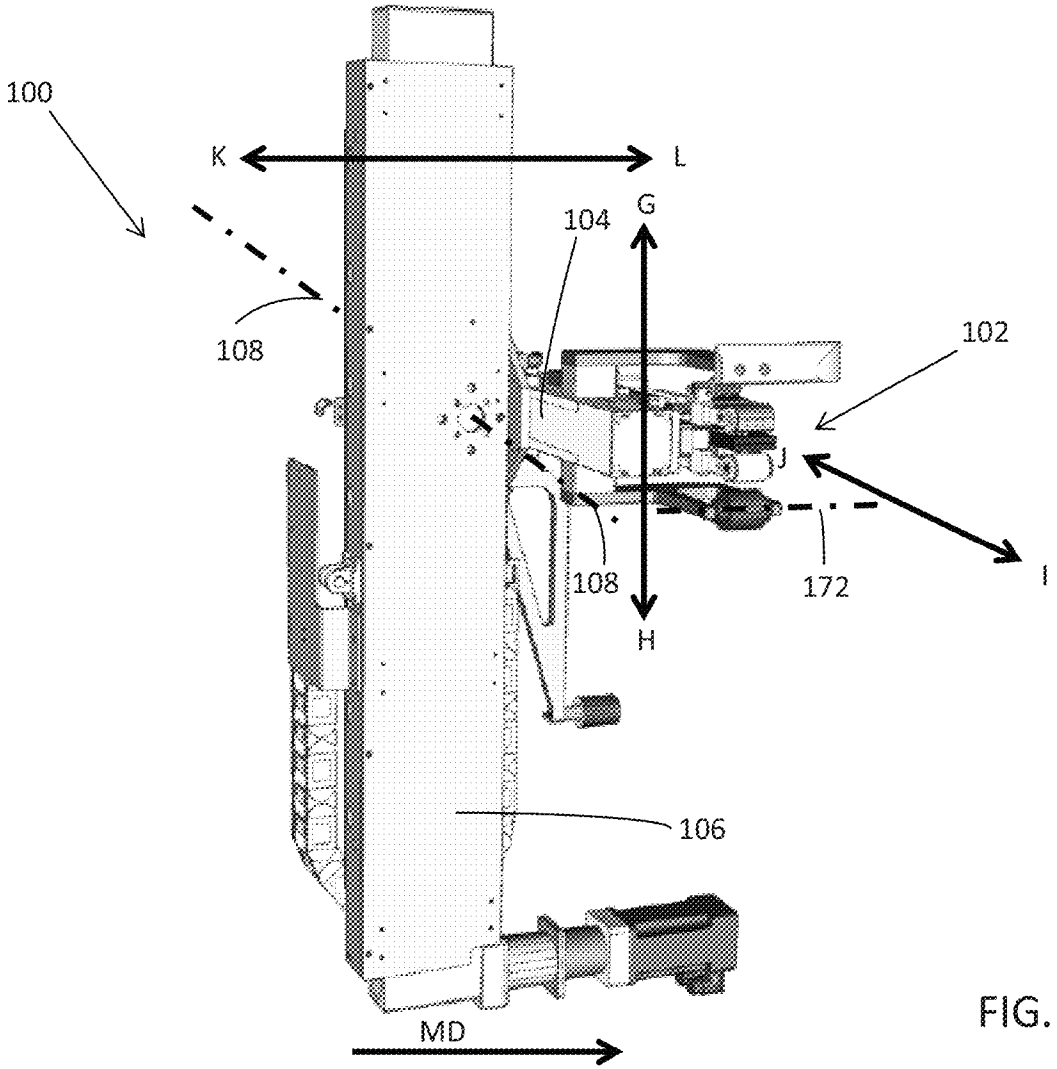
FIG. 2 is a front, perspective view of a taping apparatus in a second configuration.

As shown in FIG. 1A, a taping apparatus 100 comprises a taping member 102 movably connected with a support arm 104. The support arm 104 is movably connected with a track 106. The track 106 may rotate in a direction, M, about an axis of rotation 108 such that the support arm 104 and the taping member 102 rotate with the track 106. The track 106 may rotate from a first position, such as shown in FIG. 1A, to a second position, such as shown in FIG. 2. With the track 106 in the first position, the taping apparatus 100 may be configured in a first configuration such as shown in FIG. 1A. With the track 106 in the second position, the taping apparatus 100 may be configured in a second configuration such as shown in FIG. 2.

Figure 1B:
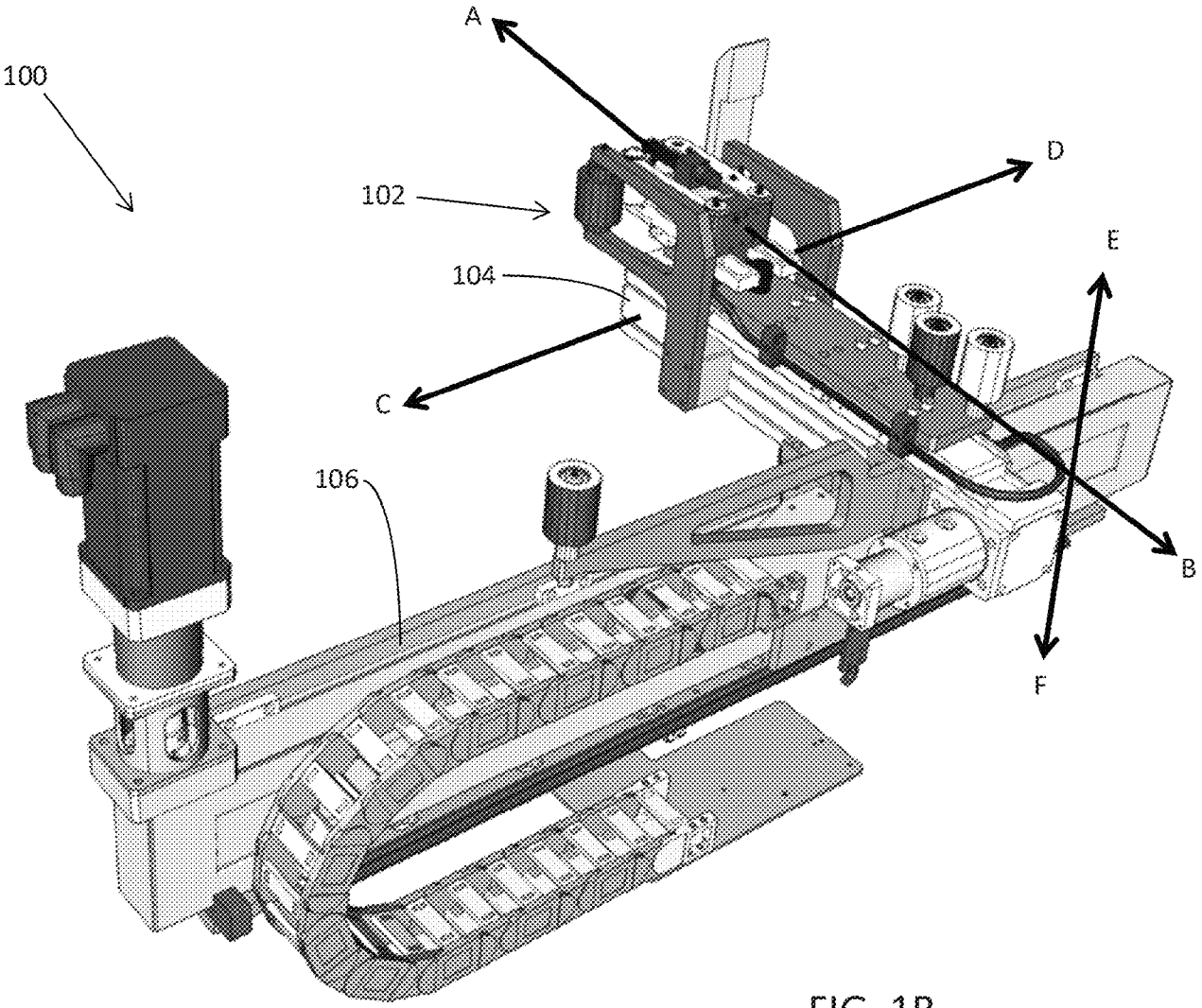
FIG. 1B is a rear, perspective view of a taping apparatus in a first configuration.

As shown in FIGS. 1A and 1B, with the taping apparatus 100 in the first configuration, the support arm 104 may be movable in a first direction and a second direction. In FIGS. 1A and 1B, the first direction is labeled as the direction, D, and the second direction is labeled as direction, C. The direction, C, is opposite the direction, D. In the first configuration, the taping member 102 is movable in a third direction and a fourth direction. In FIGS. 1A and 1B, the third direction is labeled as direction, B, and the fourth direction is labeled as direction, A, wherein the direction, A, is opposite the direction, B. The directions, C and D, are orthogonal to the directions, A and B.

As shown in FIG. 2, with the taping apparatus 100 in the second configuration, the support arm 104 may be movable in a fifth direction and a sixth direction. In FIG. 2, the fifth direction is labeled as the direction, G, and the sixth direction is labeled as the direction, H. In the second configuration, the taping member 102 may be movable in a seventh direction and an eighth direction. In FIG. 2, the seventh direction is labeled as the direction, J, and the eighth direction is labeled as the direction, I. The directions, I and J, are opposite each other and parallel to the directions, A and B.

Referring to FIG. 1A, with the taping apparatus 100 in the first configuration, the track 106 may be movable in a ninth direction and a tenth direction. In FIG. 1A, the ninth direction is shown as the direction, E, and the tenth direction is shown as the direction, F. The direction, E, is opposite the direction, F, and the directions, E and F, are orthogonal to the directions, A, B, C, and D. Referring to FIGS. 1A and 2, the directions, E and F, are parallel to the directions, G and H. With the taping apparatus 100 in the second configuration, the track 106 may be movable in an eleventh direction and a twelfth direction. In FIG. 2, the eleventh direction is shown as the direction, L, and the twelfth direction is shown as the direction, K. The directions, K and L, are opposite each other and parallel with the directions, C and D. It is to be appreciated that the track 106 may be movable in the directions, E and F, or the directions, K and L, using various devices, such as manual cranks, linear actuators, and the like.

The support arm 104 may be slidably connected with the track 106. Various devices may be used to move the support arm 104 on the track 106. For example, a linear belt actuator, linear chain actuator, or a linear screw actuator may be used. Exemplary linear belt actuators are manufactured by Bosch Rexroth AG of Germany under the designation CKR 20-145. In some exemplary configurations, a servo motor may be used to drive the actuator. Exemplary servo motors are manufactured by Rockwell Automation of Milwaukee, Wis., under the designation MPL-B330P. In some exemplary configurations, a linear motor may be used.

Figure 3:
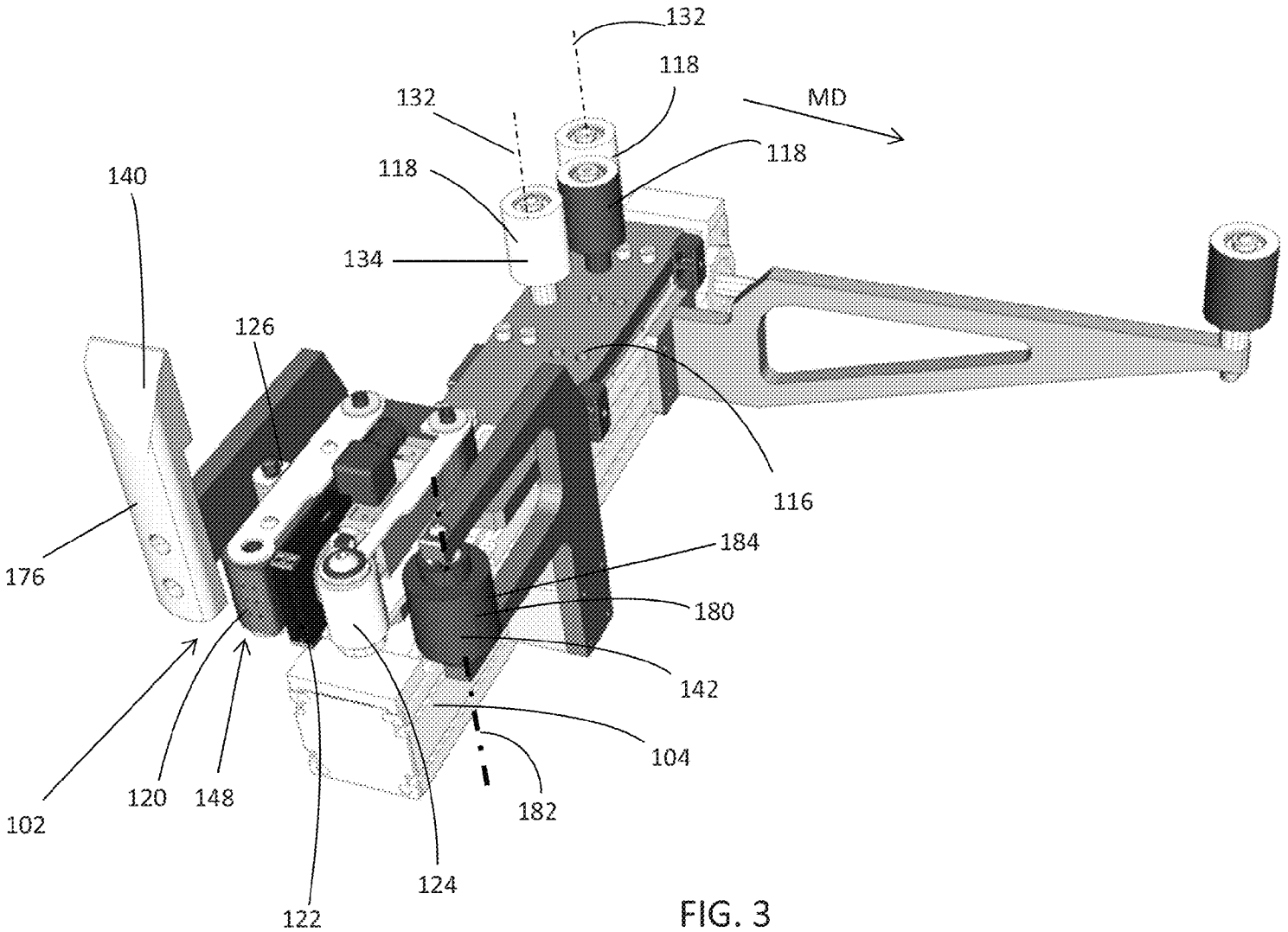
FIG. 3 is a top, perspective view of a taping member connected with a support arm.
Figure 4:
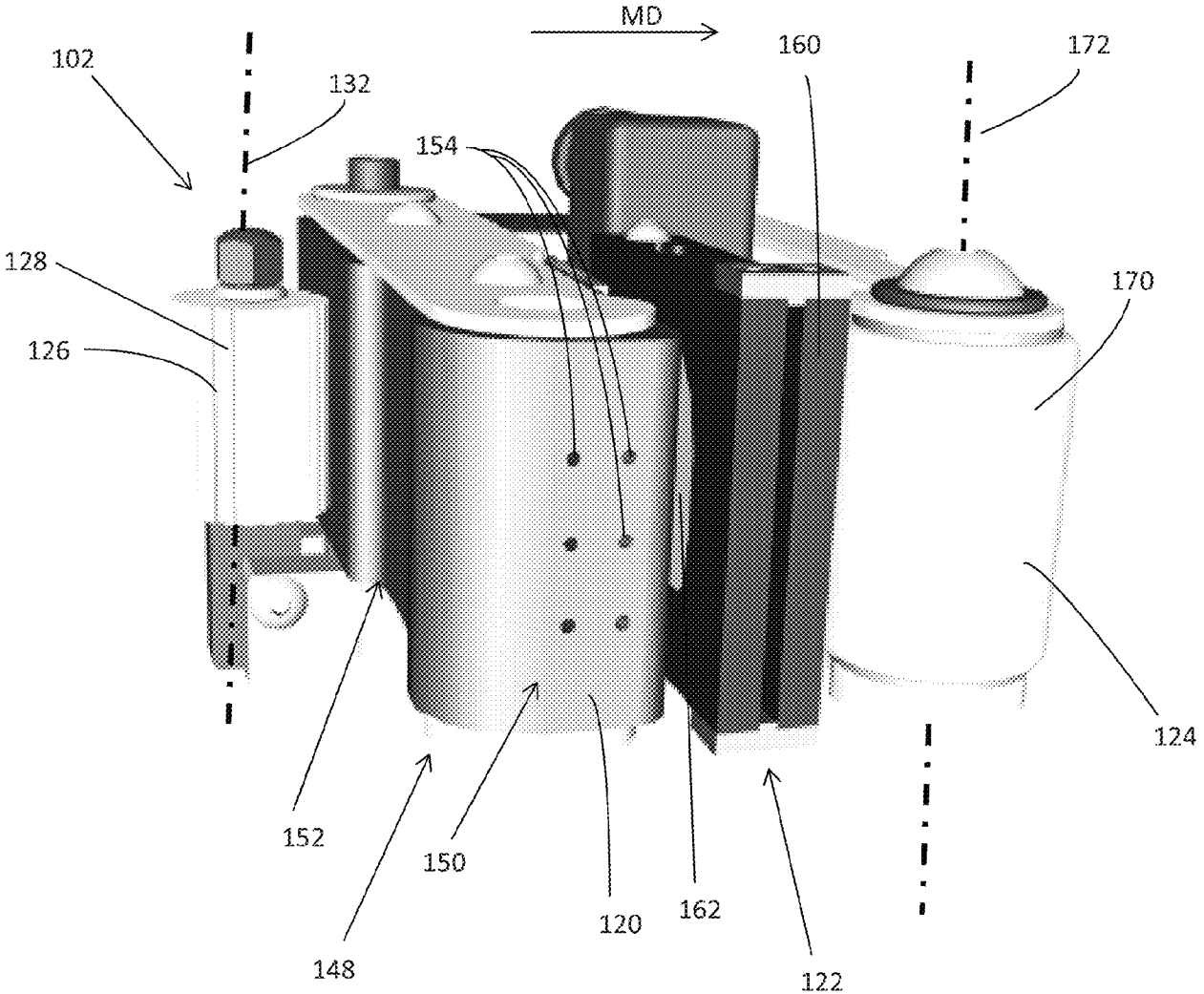
FIG. 4 is a front, perspective view of a taping member.

Referring to FIGS. 3-6, the taping member 102 has a first guide member 120, a cutting member 122 located adjacent to the first guide member 120, and a second guide member 124 located adjacent to the cutting member 122 such that the cutting member 122 is positioned between the first guide member 120 and the second guide member 124. The first guide member 120 has an outer surface 148. As shown in FIG. 4, the outer surface 148 of the first guide member may include a first outer surface 150 and a second outer surface 152 that extends orthogonal to the first outer surface 150. The first guide member 120 may have a plurality of vacuum apertures 154 in the first outer surface 150. It is to be appreciated that in some exemplary configurations, the first guide member 120 may also have a plurality of vacuum apertures 154 in the second outer surface 152. The first and/or second outer surfaces 150 and 152 of the first guide member 120 may be flat or may be curved.

Figure 5:
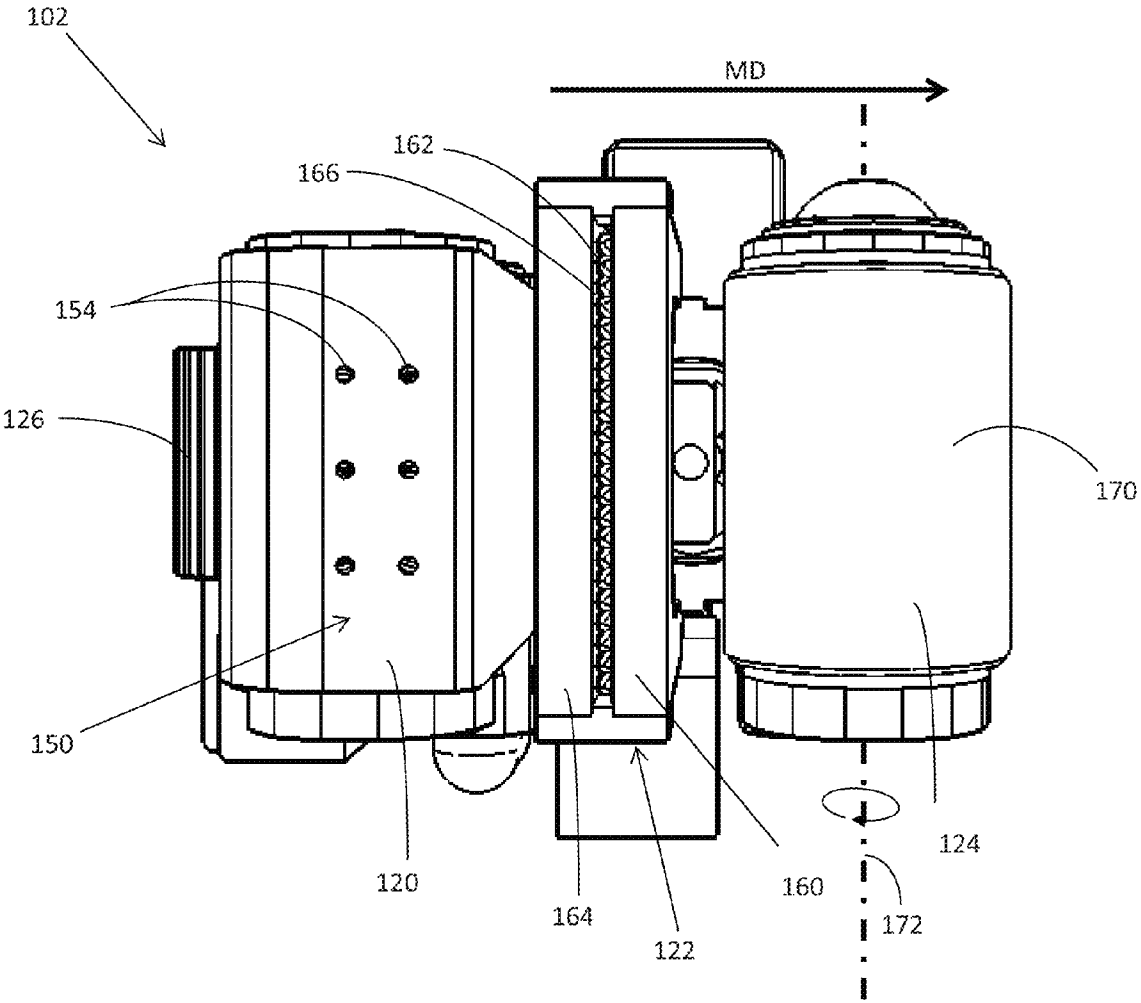
FIG. 5 is a front, elevation view of a taping member.
Figure 6:
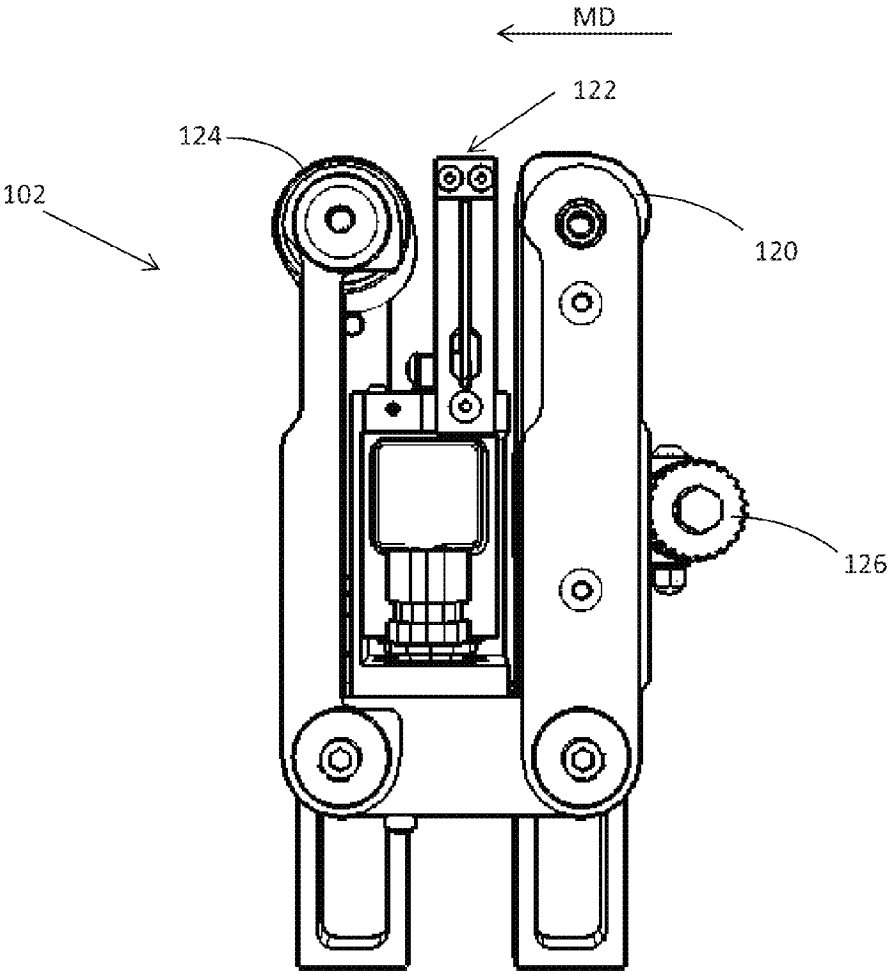
FIG. 6 is a top, plan view of a taping member.

With reference to FIGS. 4 and 5, the cutting member 122 may comprise a housing 160 and a knife 162. The housing 160 may have an outer surface 164 that that is adjacent to the second outer surface 152 of the first guide member 120. The knife 162 may have a cutting edge 166. When the taping apparatus 100 is in the first configuration, such as shown in FIG. 1A, the cutting edge 166 may extend parallel with the directions, E and F. When the taping apparatus 100 is in the second configuration, such as shown in FIG. 2, the cutting edge 166 may extend parallel with the directions, K and L. In some exemplary configurations, with the taping apparatus 100 in the first configuration, the knife 162 may be movable in directions parallel with the directions, A and B. With the taping apparatus 100 in the second configuration, the knife 162 may be movable in a direction that is parallel with the directions, I and J. While the cutting member 122 shown in FIGS. 4 and 5 has a knife 162, it is to be appreciated that the cutting member 122 may comprise various devices that are capable of cutting a continuous length of tape.

As shown in FIG. 4, the second guide member 124 may be in the form of a roller. The second guide member 124 has an outer surface 170. When the taping apparatus 100 is in the first configuration such as shown in FIG. 1A, the second guide member 124 may rotate about an axis of rotation 172 that extends parallel with the directions, E and F. When the taping apparatus 100 is in the second configuration such as shown in FIG. 2, the axis of rotation 172 may extend parallel with the directions, K and L. The outer surface 170 of the second guide member 124 may be smooth such as shown in FIG. 4. In other exemplary configurations, the second guide member 124 may comprise ribs or protrusions extending from the outer surface 170.

As shown in FIG. 4, the taping member 102 may also comprise a guide roller 126. The guide roller 126 may have an outer surface 128 and may be rotatable about an axis of rotation 130 that is parallel with the axis of rotation 172 of the second guide member 124. As shown in FIG. 4, the guide roller 126 may comprise ribs protruding outward from the outer surface 128. Or, in other exemplary configurations, the outer surface 128 of the guide roller 126 may be smooth. The outer surface 128 of the guide roller 126 may comprise a material such as rubber, silicone, or polyurethane that may not stick to the adhesive on the second surface of the continuous length of tape.

Figure 7:
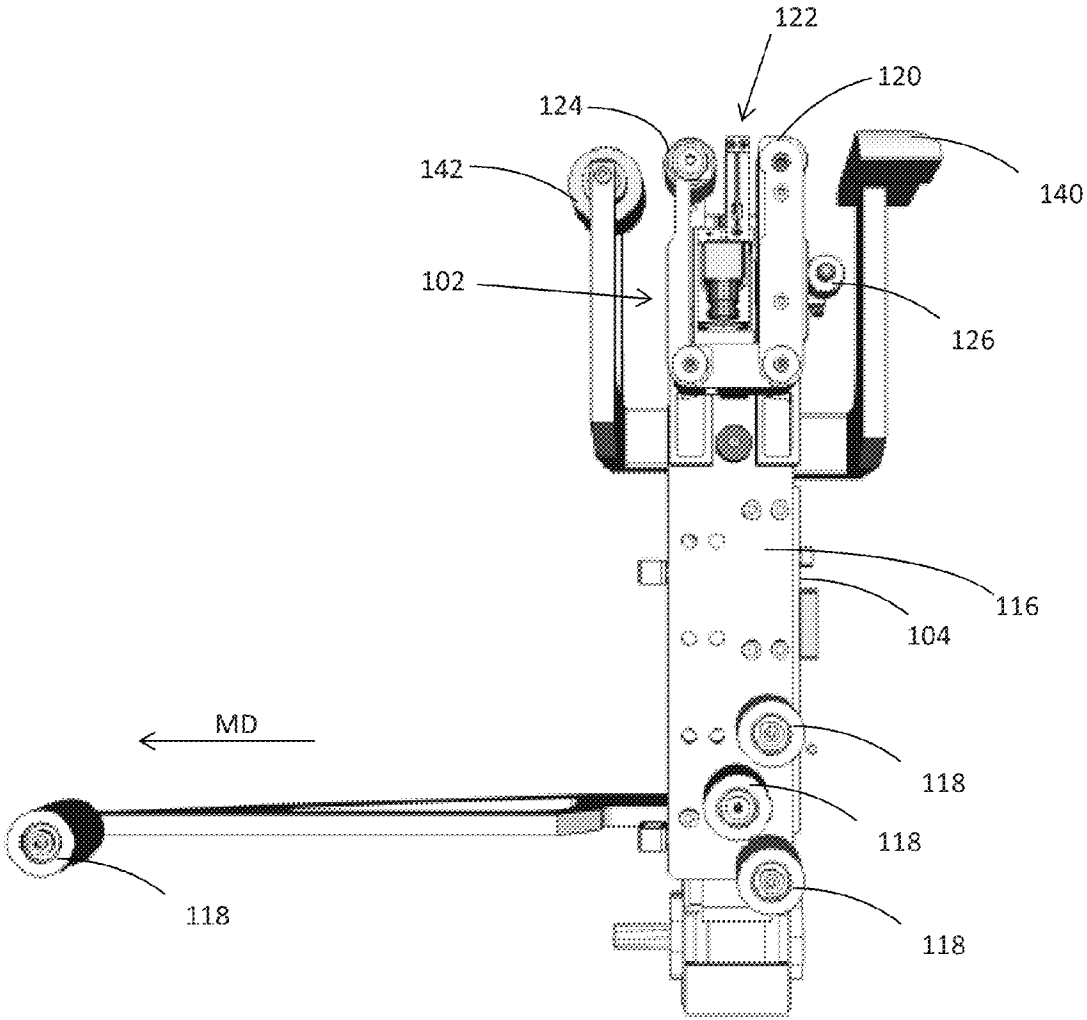
FIG. 7 is a top, plan view of a taping member connected with a support arm.

The taping member 102 may be slidably engaged with the support arm 104. For example, as shown in FIG. 7, the taping member 102 may be connected with a base 116. The base 116 may be configured to slide on the support arm 104. The base 116 may be fixed to the taping member 102. As such, with reference to FIGS. 1A and 7, with the taping apparatus 100 in the first configuration, the base 116 may move the taping member 102 in the directions, A and B, while the support arm 104 remains stationary relative to the directions, A and B. Similarly, referring to FIGS. 2 and 7, with the taping apparatus 100 in the second configuration, the base 116 may move the taping member 102 in the directions, I and J, while the support arm 104 remains stationary relative to the, I and J. The base 116 may be configured to slide on the support arm 104 using various devices. For example, a linear actuator may be used to move the base 116. Exemplary linear actuators are manufactured by Bosch Rexroth AG of Germany under the designation MKR 20-80. In some exemplary configurations, a servo motor may be used to drive the linear actuator. Exemplary servo drive motors are manufactured by Rockwell Automation of Milwaukee, Wis., under the designation MPL-B330P. Various other motors, such as a linear motor, may be used.

Referring to FIG. 3, in some exemplary configurations, the taping apparatus 100 may comprise a third guide member 140. The third guide member 140 is connected with the support arm 104. The third guide member 140 may be positioned adjacent to the first guide member 120 of the taping member 102. The third guide member 140 may have a curved outer surface 176 as shown in FIG. 3. As discussed in more detail below, the third guide member 140 may be configured to guide the first and second end flaps of the container to a fully closed configuration.

The taping apparatus 100 may also comprise a resilient guide member 142 connected with the support arm 104 and located adjacent to the second guide member 124 of the taping member 102. As shown in FIG. 3, the resilient guide member 142 may be configured as a roller. The resilient guide member 142 may be rotatable about an axis of rotation 182 that is parallel with the axis of rotation of the second guide member 124 as shown in FIG. 4. The resilient guide member 142 may comprise a plurality of bristles 184 protruding from the outer surface 180 of the resilient guide member 142. As discussed in more detail below, the bristles 184 may be configured to flex away from the container as the bristles 184 press the tape to the container. In some exemplary configurations, the outer surface 180 of the resilient guide member 142 may comprise a material such as silicone, polyurethane, or rubber. In some exemplary configurations, the resilient guide member 142 may be comprised entirely of a resilient material.

Figure 8:
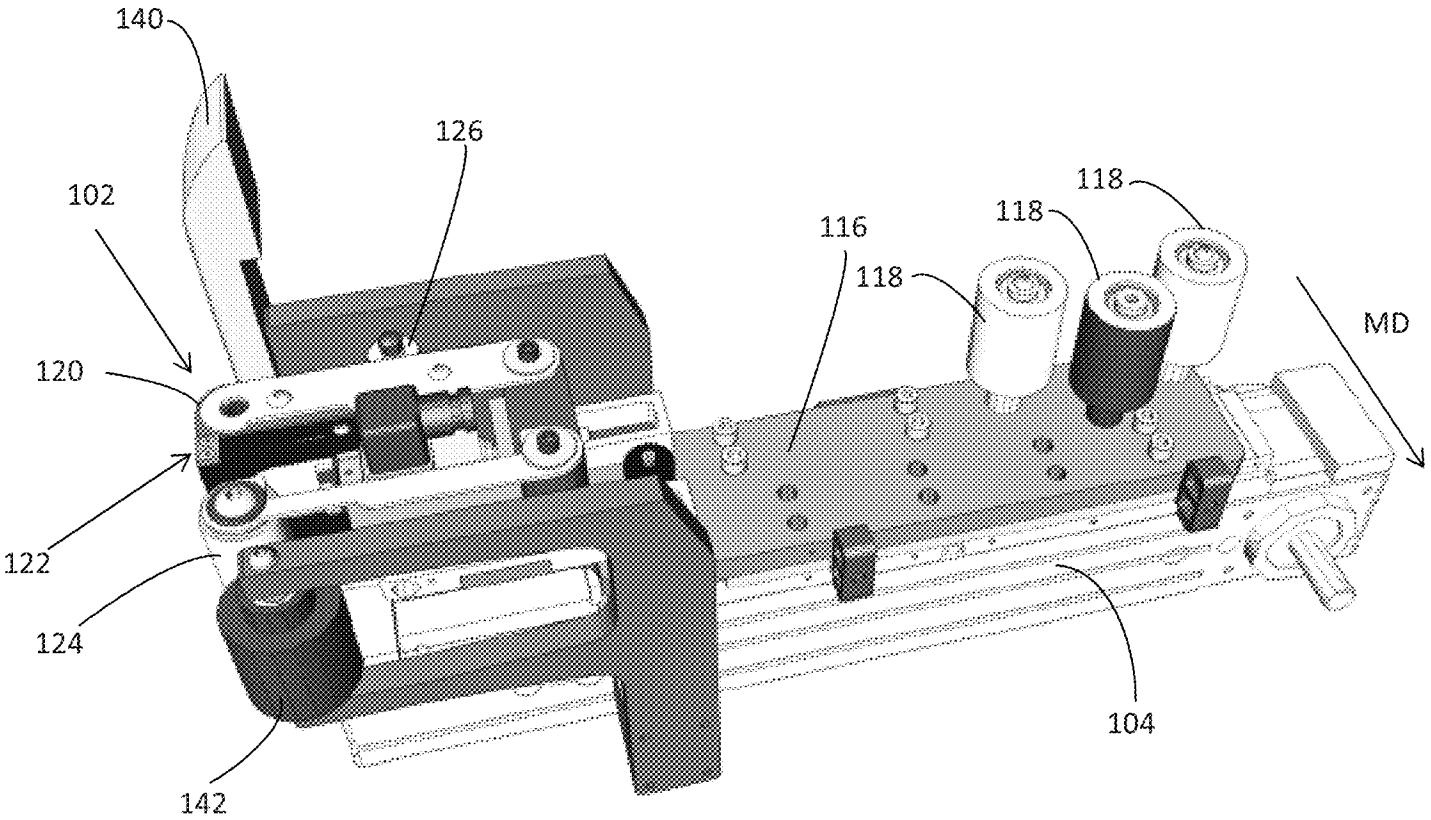
FIG. 8 is a top, perspective view of a taping member connected with a support arm.

As shown in FIGS. 3, 7, and 8, the taping apparatus may comprise a plurality of rollers 118. The rollers 118 may be connected with the base 116. In some exemplary configurations, rollers 118 may be arranged in various locations within the taping apparatus 100. Each roller 118 may be configured to rotate about an axis of rotation 132 that is parallel with the axis of rotation 182 of the resilient guide member 142. In some exemplary configurations, some or all of the rollers 118 may be stationary. It is to be appreciated that the rollers 118 may be positioned to guide the continuous length of tape from a supply roll to the taping member 102. The rollers 118 may have an outer surface 134. The outer surface 134 may comprise a material such as rubber, silicone, and polyurethane. The rubber, silicone, or polyurethane rollers may prevent the tape from sticking to the rollers 118 in a configuration where the adhesive on the second side of the tape is facing the roller 118. Rollers 118 that are not in contact with the second surface of the tape may be made of a variety of rigid materials, such as aluminum or steel.

Figures 9A, 9B:
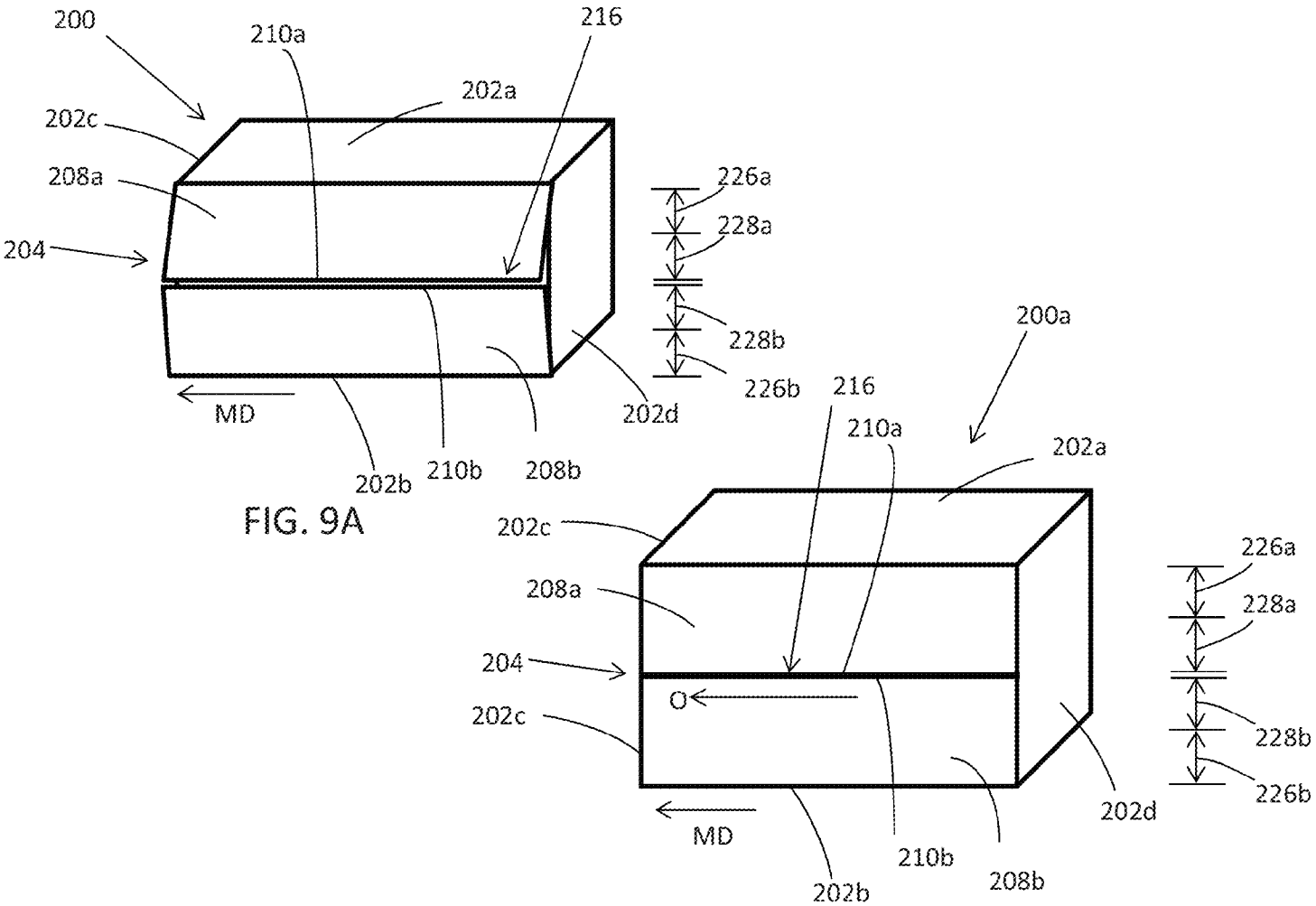
FIG. 9A is a front, perspective view of a container oriented in a first orientation.
FIG. 9B is a front, perspective view of a container oriented in a first orientation and having first and second end flaps in fully closed configuration.
Figure 10B:
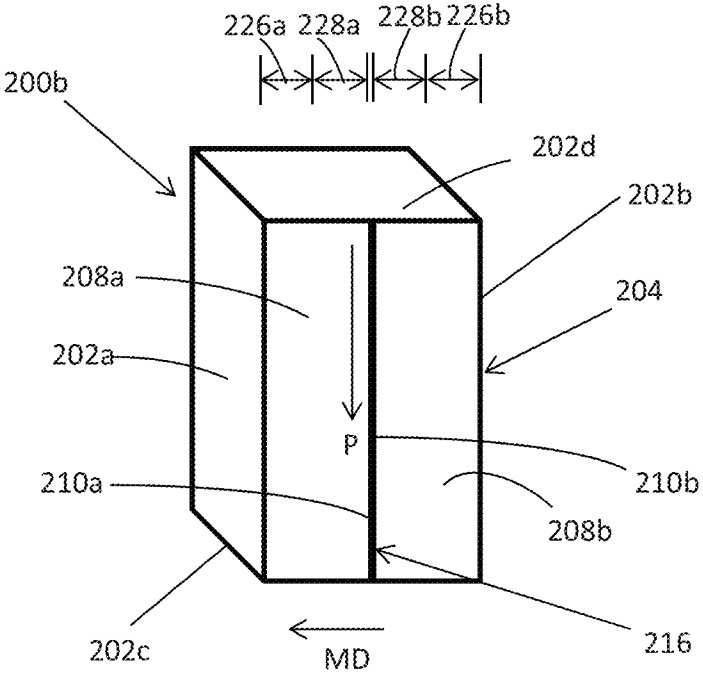
FIG. 10B is a front, perspective view of a container oriented in a second orientation and having first and second end flaps in a fully closed configuration.

The taping apparatus may be configured to tape containers 200 such as shown in FIGS. 9A and 10B. The container 200 includes first and second opposing side walls 202*a* and 202*b* and third and fourth opposing side walls 202*c* and 202*d*. The container 200 may include a first end 204 and an opposing second end. The first end 204 may comprise a first end flap 208*a* and a second end flap 208*b*. The first end flap 208*a* may comprise a proximal region 226*a* and a distal region 228*a*. The proximal region 226*a* of the first end flap 208*a* may be pivotally connected with the first side wall 202*a*. Similarly, the second end flap 208*b* may comprise a proximal region 226*b* and a distal region 228*b*. The proximal region 228*b* of the second end flap 208*b* may be pivotally connected with the second side wall 202*b*. The first end flap 208*a* has a first edge 210*a* and the second end flap 208*b* has a second edge 210*b*. The first and second edges 210*a* and 210*b* are adjacent to each other. The first and second edges 210*a* and 210*b* may be separated by a slit 216. When the container 200 is in a closed configuration, the first end flap 208*a* and the second end flap 208*b* may be coplanar such as shown in FIGS. 9B and 10B.

The taping apparatus may be used to tape containers in different orientations. For example, as shown in FIG. 9B, a first container 200*a* may advance to the taping apparatus in the orientation where the slit 216 of the first container 200*a* extends in a first direction that is parallel to the machine direction MD. In FIG. 9B, the first direction is shown as direction, O. In another exemplary configuration, such as shown in FIG. 10B, a second container 200*b* may advance to the taping apparatus in an orientation where the slit 216 extends in a second direction that is orthogonal to the machine direction MD. In FIG. 10B, the second direction is shown as the direction, P.

The taping apparatus may be configured to tape containers of various dimensions. For example, the taping apparatus may be configured to tape containers of various lengths, widths, and heights. For example the length of a container may range from about 200 millimeters to about 600 millimeters; the width of a container may range from about 150 millimeters to about 500 millimeters; and the height of a container may range from about 150 millimeters to about 500 millimeters.

Figure 12:
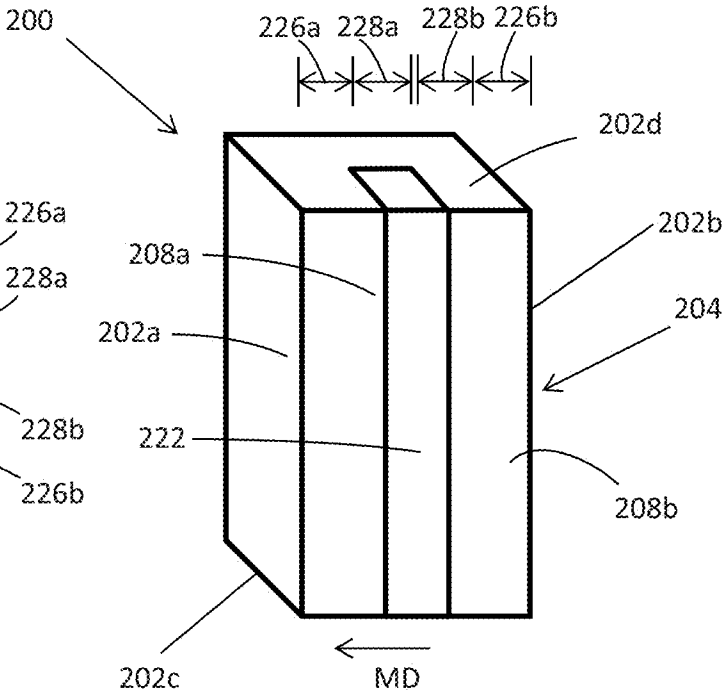
FIG. 12 is a front, perspective view of a container oriented in a second orientation and having a discrete length of tape adhered to first and second end flaps of the container.
Figure 11:
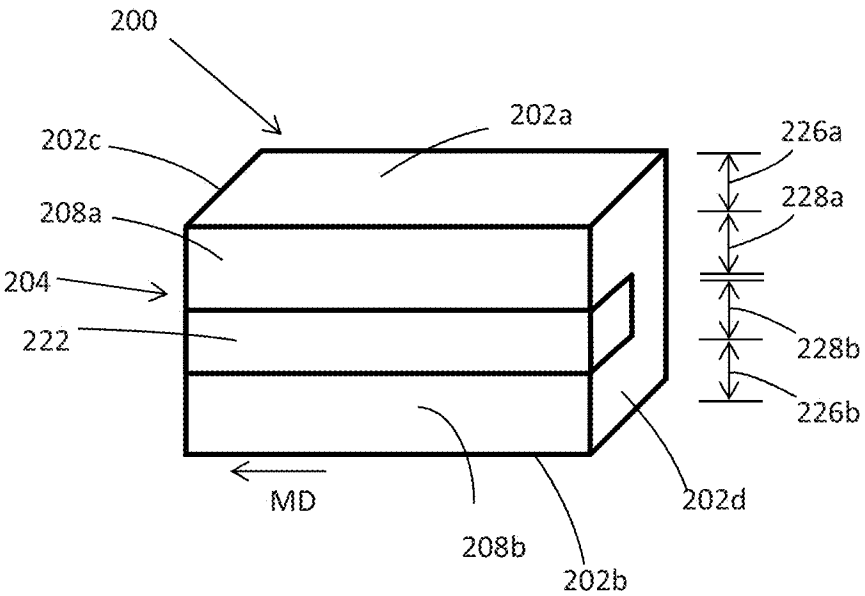
FIG. 11 is a front, perspective view of a container oriented in a first orientation and having a discrete length of tape adhered to first and second end flaps of the container.
Figure 13:
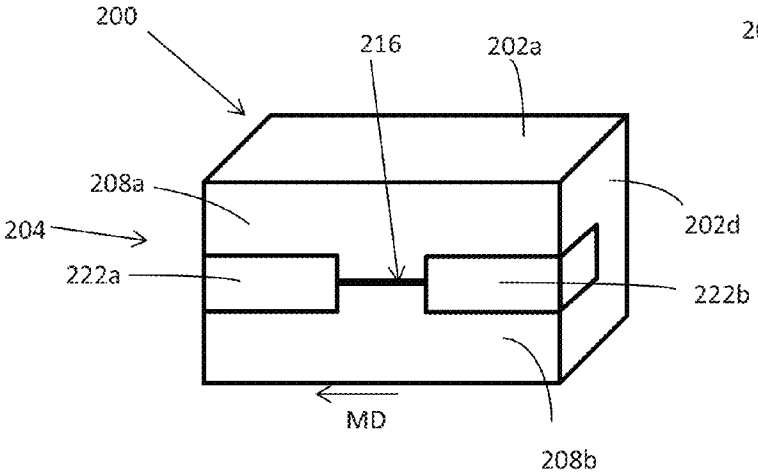
FIG. 13 is a front, perspective view of a container oriented in a first orientation and having two discrete lengths of tape adhered to first and second end flaps of the container.
Figure 14:
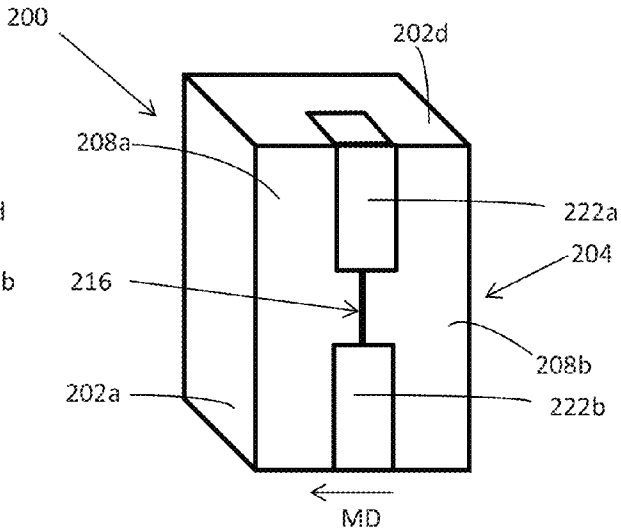
FIG. 14 is a front, perspective view of a container oriented in a second orientation and having two discrete lengths of tape adhered to first and second end flaps of the container.
Figure 15A:
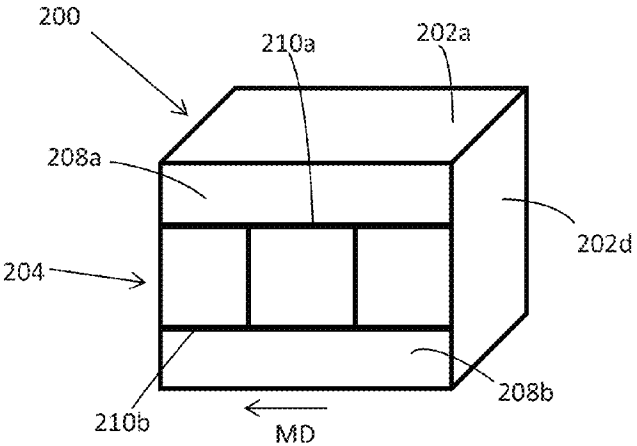
FIG. 15A is a front, perspective view of a container oriented in a first orientation.
Figure 15B:
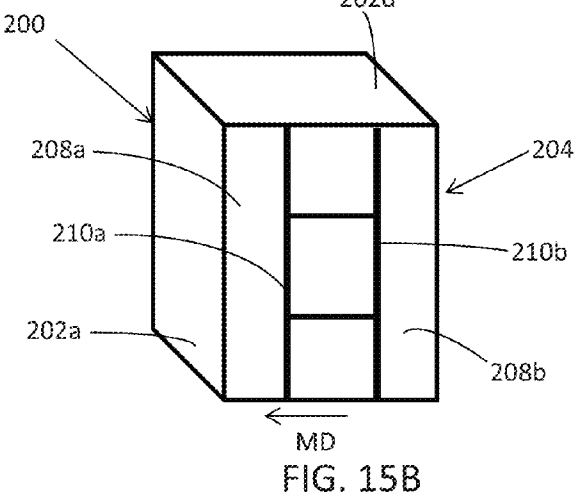
FIG. 15B is a front, perspective view of a container oriented in a second orientation.
Figure 16B:
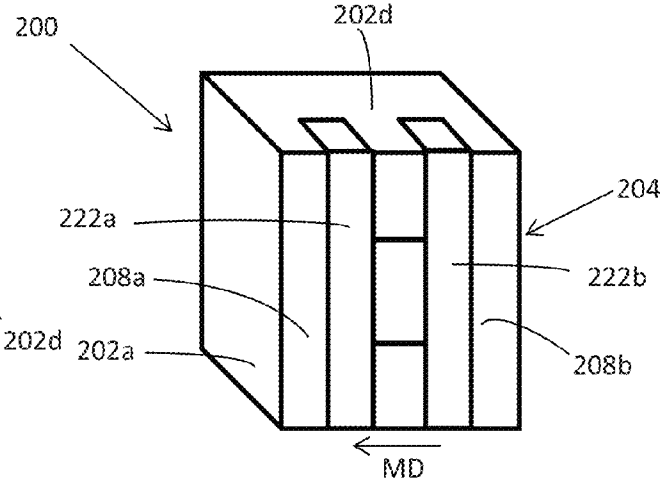
FIG. 16B is a front, perspective view of a container oriented in a second orientation and having two discrete lengths of taped adhered to first and second end flaps of the container.
Figure 16A:
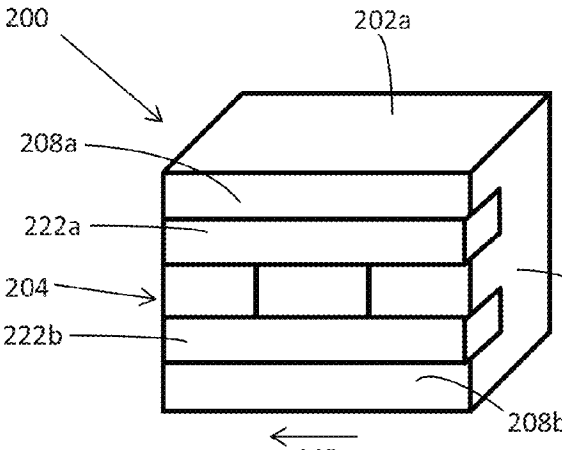
FIG. 16A is a front, perspective view of a container oriented in a first orientation and having two discrete lengths of taped adhered to first and second end flaps of the container.

The taping apparatus may be configured to apply a single discrete length of tape 222 continuously from the third side wall 202*c* to the fourth side wall 202*d* such as shown in FIGS. 11 and 12. Or, in other exemplary configurations such as shown in FIGS. 13 and 14, the taping apparatus may be configured to intermittently apply a first discrete length of tape 222*a* to the third side wall 202*c* and the first and second end flaps 208*a* and 208*b* and a second discrete length of tape 222*b* to the first and second end flaps 208*a* and 208*b* and the fourth side wall 202*d*. Intermittently applying multiple discrete lengths of tape may save material costs. As such, it may be desirable to intermittently apply multiple discrete lengths of tape to a container 200 so long as the discrete lengths of tape are sufficient to keep the container 200 sealed during shipping and handling.

Figure 17B:
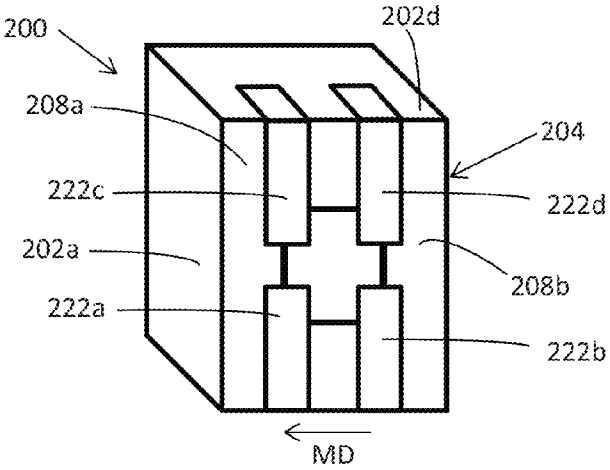
FIG. 17B is a front, perspective view of a container oriented in a second orientation and having four discrete lengths of taped adhered to first and second end flaps of the container.
Figure 17A:
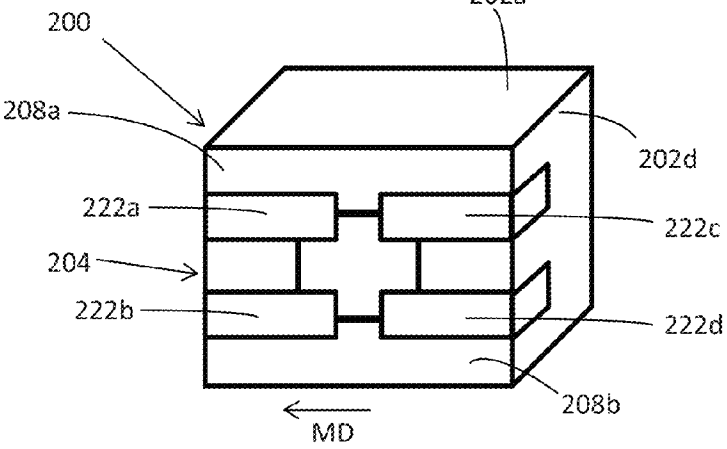
FIG. 17A is a front, perspective view of a container oriented in a first orientation and having four discrete lengths of taped adhered to first and second end flaps of the container.

In some exemplary configurations, the taping apparatus may comprise two taping members. In such an exemplary configuration, referring to FIGS. 15A, 15B, 16A, and 16B, the taping apparatus may be configured to concurrently apply a first discrete length of tape 222*a* and a second discrete length of tape 222*b* to the container 200. Each taping member may be configured to apply tape continuously or intermittently to the container 200. The containers 200 shown in FIGS. 17A and 17B have first, second, third, and fourth discrete lengths of tape 222*a*, 222*b*, 222*c*, and 222*d* that may be applied concurrently by two taping members.

Referring to FIGS. 1A, 1B, 3, 4, 5, 9A, 9B, and 18, the taping apparatus 100 may tape a container 200 that is oriented such that the slit 216 extends parallel with the machine direction MD. In such an exemplary configuration, the taping apparatus 100 may configured in the first configuration and the track 106 may be arranged in the first position. In operation, a continuous length of tape 220 is guided around the rollers 118, is then received on the second outer surface 152 of the first guide member 120, and is then received on the first outer surface 150 of the first guide member 120 of the taping member 102. The continuous length of tape 220 may be positioned such that a first surface 230 of the continuous length of tape 220 faces the first outer surface 150 of the first guide member 120 and a second surface 232 faces away from the first outer surface 150 of the first guide member 120. The second surface 232 of the continuous length of tape 220 may comprise an adhesive. Vacuum is applied through the vacuum apertures 154 in the first guide member 120 to hold the continuous length of tape 220 until the taping apparatus 100 begins applying the continuous length of tape 220 to the container 200. The container 200 may advance in the machine direction MD to the taping apparatus 100. The container 200 may stop advancing in the machine direction MD once the container 200 is positioned adjacent to the taping member 102. The container 200 may oriented such that the first end 204 of the container is facing the taping member 102. With the container 200 stopped, the taping member 102 moves in the direction, A, toward the container 200, until the taping member 102 is positioned adjacent to the third side wall 202*c* of the container 200. Vacuum is then turned off to the first guide member 120. The taping member 102 moves in the direction, B, adjacent to the container 200 and the second outer surface 152 of the first guide member 120 concurrently presses the continuous length of tape 220 to the container 200. Once the second outer surface 152 of the first guide member 120 advances beyond the third side wall 202*c* of the container 200, the taping member 102 stops advancing in the direction, B.

Subsequently, with reference to FIGS. 1A, 1B, 3, 4, 5, 9A, 9B, 19, and 20, the support arm 104 advances the taping member 102 in the direction, D. As the support arm 104 moves in the direction, D, the third guide member 140 directs the first and second end flaps 208*a* and 208*b* to a fully closed, coplanar configuration as shown in FIG. 9B such that the tape 220 may be applied to a flat surface. The first outer surface 150 of the first guide member 120 directs the continuous length of tape 220 toward the distal regions 228*a* and 228*b* of the first and second end flaps 208*a* and 208*b* of the container 200. Then, the outer surface 170 of the second guide member 124 presses the tape 220 to the first and second end flaps 208*a* and 208*b* of the container 200. In an exemplary configuration where the second guide member 124 is in the form of a roller, the second guide member 124 may roll over the tape 220 to seal the tape 220 to the container 200. Additionally, the outer surface 180 of the resilient guide member 142 may roll over the tape 220 and apply pressure to the tape 220 to adhere the tape 220 to the container 200. As the resilient guide member 142 rolls over the tape 220, the outer surface 180 may deform as a result of the compressive force that is applied to the resilient member 142 by the container 200. Once the entire taping member 102 advances beyond the first end 204 of the container 200, the support arm 104 stops advancing in the direction, D.

Next, referring to FIGS. 1A, 1B, 3, 4, 5, 9A, 9B, and 21, the taping member 102 moves in the direction, A, toward the container 200 to direct the continuous length of tape 220 to the fourth side wall 202*d* of the container 200. As the taping member 102 advances in the direction, A, tape 220 is dispensed from the taping member 102. The second guide member 124 helps direct the continuous length of tape 220 into contact with the container. Once a sufficient length of tape 220 is dispensed to the fourth side wall 202*d*, the cutting member 122 cuts the continuous length of tape 220 to form a discrete length of tape 222 that is adhered to the container 200. Prior to the cutting member 122 cutting the tape 220, vacuum may be applied to the continuous length of tape 220 through the vacuum apertures 154 of the first outer surface 150 of the first guide member 120. Vacuum helps to hold the continuous length of tape 220 such that the continuous length of tape 220 remains threaded around the rollers 118 and positioned adjacent to the first outer surface 150 of the first guide member 120 after the cutting member 122 cuts the tape 220. As a result, the taping apparatus 100 is ready to tape a subsequent container. As the continuous length of tape 220 is held to the first outer surface 150 of the first guide member 120 using vacuum, the knife 162 moves in the direction, A, from the housing 160 and the cutting edge 166 applies pressure to the continuous length of tape 220 until the continuous length of tape 220 separates to form a discrete length of tape 222. After the discrete length of tape 222 is cut, the taping member 102 continues to move in the direction, A, such that the second guide member 124 may seal the discrete length of tape 222 to the container 200.

Figure 18:
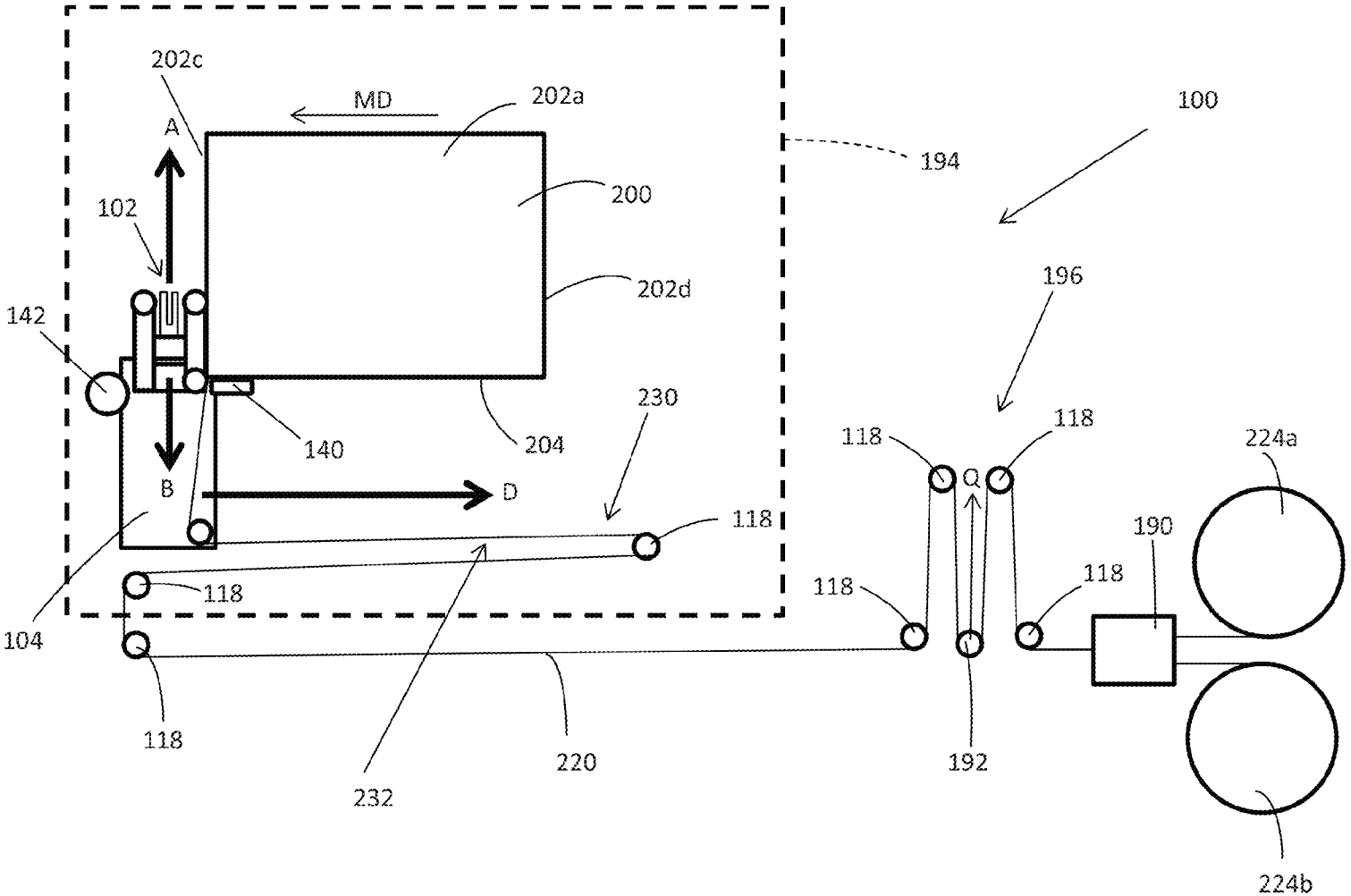
FIG. 18 is a plan view of a taping apparatus. having a taping member positioned adjacent to a third side wall of a container
Figure 21:
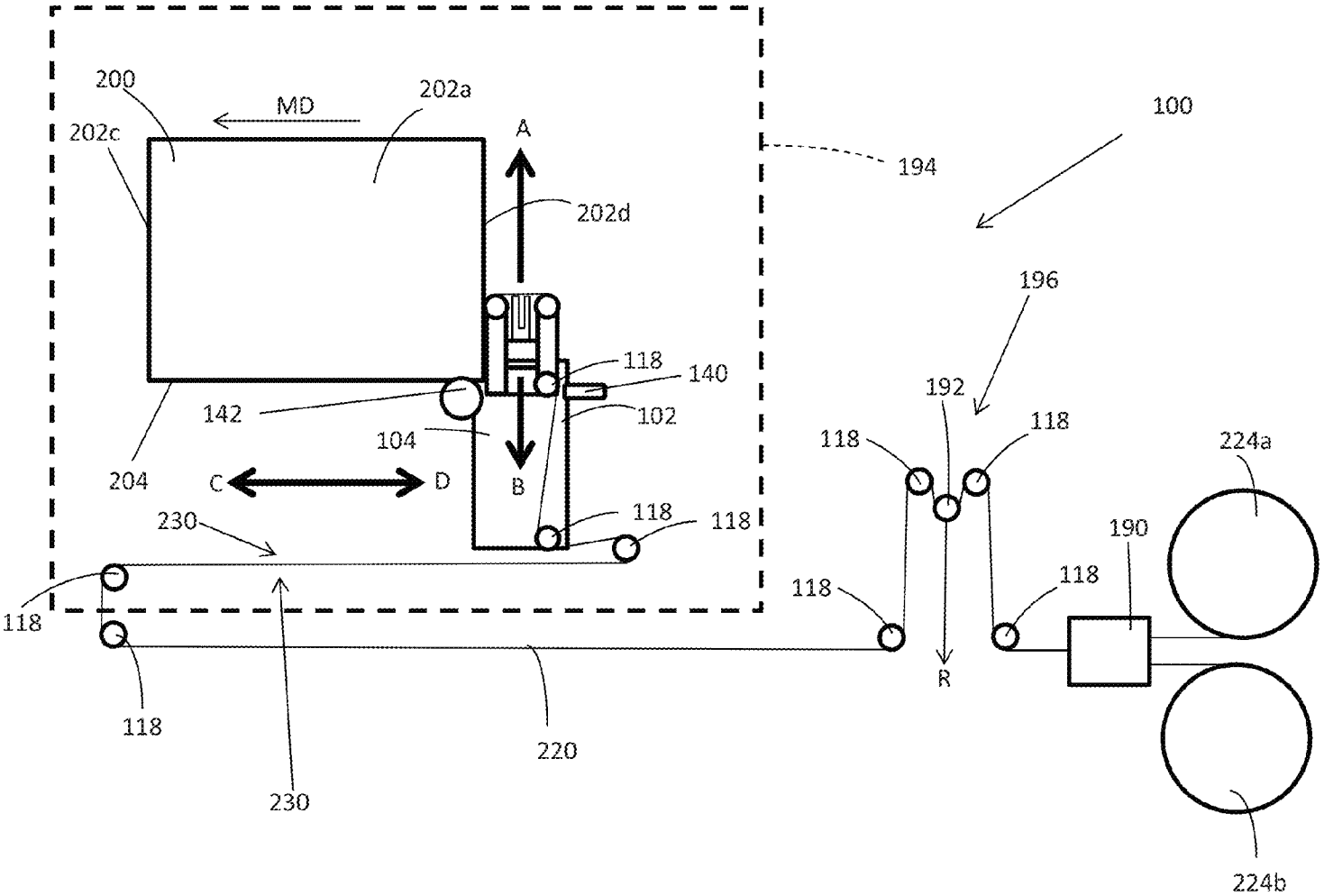
FIG. 21 is a plan view of a taping apparatus having a taping member positioned adjacent to a fourth side wall of a container.

Referring to FIGS. 18 and 21, the taping member 102 may advance in the direction, B, away from the container 200 and the container 200 may advance in the machine direction MD, away from the taping apparatus 100. The support arm 104 then moves on the track 106 in the direction, C, in preparation for taping a subsequently advancing container.

In order to hold the container 200 at rest as the taping apparatus 100 tapes the container 200, various holding devices may be used, including grippers and positioning plates. For example, the first, second, third, and fourth side walls 202*a*, 202*b*, 202*c*, and 202*d* and/or the second end of the container 200 may be held in place and prevented from movement during the taping process. While the taping apparatus 100 is described as taping a container 200 that is at rest, it is to be appreciated that in some exemplary configurations, the taping apparatus 100 may be configured to tape a container 200 as the container 200 advances in the machine direction MD.

As discussed above, the taping apparatus 100 may be configured to apply tape intermittently to a container 200, such as shown in FIG. 13. With reference to FIGS. 1A, 1B, 3, 4, 5, 9A, 9B, 13, and 18-20 in an exemplary configuration where a container 200 advances in the machine direction MD such that the slit 216 extends parallel with the machine direction MD, the taping apparatus 100 is configured in the first configuration and the track 106 may be arranged in the first position. The method of applying two or more discrete lengths of tape to the container 200 is similar to the method discussed above for applying a single discrete length of tape 222 to the container 200. The taping apparatus 100 applies a continuous length of tape 220 to the third side wall 202*c* and to a portion of the distal regions 228*a* and 228*b* of the first and second end flaps 208*a* and 208*b*. Once the taping member 102 applies a predetermined length of tape 220 to the container 200, the cutting member 122 cuts the continuous length of tape 220 to form a first discrete length of tape 222*a* that is adhered to the container 200. The support arm 104 continues advancing in the direction, D. Vacuum is applied to the continuous length of tape 220 before the cutting member 122 cuts the tape 220 to hold the continuous length of tape 220 on the first guide member 120 until the second discrete length of tape 222*b* is applied to the container 200. The outer surface 170 of the second guide member 124 applies pressure to the first discrete length of tape 222*a* as the support arm 104 continues advancing in the direction, D, to seal to the first discrete length of tape 222*a* to the container 200. Then, at a predetermined location along the distal regions 228*a* and 228*b* of the first and second end flaps 208*a* and 208*b*, vacuum is turned off to the first guide member 120. As a result, the continuous length of tape may be directed toward the container 200 as the support arm 104 and taping member 102 continue to move in the direction, D. The outer surface 170 of the second guide member 124 and the outer surface 180 of the resilient guide member 142 may apply pressure to seal the tape 220 to the container 200. Once the entire taping member 102 advances beyond the container 200, the support arm 104 stops advancing in the direction, D.

Subsequently, the taping member 102 moves in the direction, A, toward the container 200 to direct the continuous length of tape 220 to the fourth side wall 202*d* of the container 200. As the taping member 102 advances in the direction, A, tape 220 is dispensed from the taping member 102. The second guide member 124 helps direct the tape 220 toward the container 200 and apply pressure to seal the tape 220 to the container 200. Once a sufficient length of tape 220 is dispensed to the fourth side wall 202*d*, the cutting member 122 cuts the continuous length of tape 220 to form a second discrete length of tape 222*b* that is adhered to the container 200. Before the cutting member 122 cuts the tape 220, vacuum may be applied to the continuous length of tape 220. Then, the taping member 102 may advance in the direction, B, away from the container 200 and the container 200 may advance in the machine direction MD, away from the taping apparatus 100. The support arm 104 then moves on the track 106 in the direction, C, in preparation for taping a subsequent container.

Figure 10A:
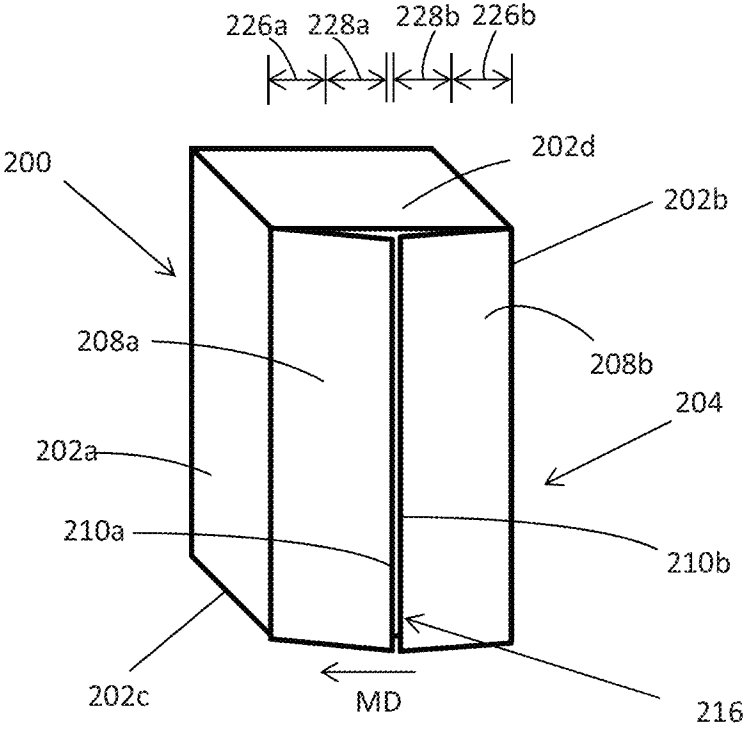
FIG. 10A is a front, perspective view of a container oriented in a second orientation.

Also discussed above, the taping apparatus 100 may be configured to tape a container 200 that advances in the machine direction MD such that the slit 216 extends orthogonal to the machine direction MD such as shown in FIG. 10A. As shown in FIG. 2, in such an exemplary configuration, the taping apparatus 100 is configured in the first configuration and the track 106 is arranged in the second position. In order to shift the taping apparatus 100 from the first configuration shown in FIG. 1A to the second configuration shown in FIG. 2, the track 106 may rotate in the direction, M, about the axis of rotation 108. In some exemplary configurations, the track 106 may rotate opposite the direction, M, about the axis of rotation 108.

With the taping apparatus 100 in the second configuration as shown in FIG. 2, a container 200 advances in the machine direction MD to the taping apparatus 100. Referring to FIGS. 2, 3, 4, 5, 10A, and 10B, the container 200 stops advancing in the machine direction MD once the container 200 is adjacent to the taping member 102. A continuous length of tape 220 is threaded around the rollers 118 and to the taping member 102. With the container 200 stopped, the taping member 102 moves in the direction, I, toward the container 200. Vacuum is applied through the first guide member 120 to hold the continuous length of tape 220 to the taping member 102 as the taping member 102 moves in the direction, I. The taping member 102 moves in the direction, I, until the taping member 102 is positioned adjacent to the third side wall 202*c* of the container 200. Vacuum is then turned off to the first guide member 120. The taping member 102 then moves in the direction, J, adjacent to the container 200 as the continuous length of tape 220 is applied to the container 200. As the taping member 102 advances in the direction, J, the second outer surface 152 of the first guide member 120 directs the continuous length of tape 220 to the container 200. Once the taping member 102 advances beyond the third side wall 202*c* of the container 200, the taping member stops advancing in the direction, J.

Then, the support arm 104 advances the taping member 102 in the direction, G. As the support arm 104 moves in the direction, G, the third guide member 140 directs the first and second end flaps 208*a* and 208*b* to a fully closed, coplanar configuration. The first outer surface 150 of the first guide member 120 directs the continuous length of tape 220 toward the container 200. Then, the outer surface 170 of the second guide member 124 may press the tape 220 into contact with the container. Additionally, the outer surface 180 of the resilient guide member 142 may roll over the tape 220 and apply pressure to the tape 220 to seal the tape 220 to the container 200. Once the entire taping member 102 advances beyond the container 200 in the direction, G, the support arm 104 stops advancing in the direction, G.

Next, the taping member 102 moves in the direction, I, toward the container 200 to direct the continuous length of tape 220 to the fourth side wall 202*d* of the container 200. As the taping member 102 advances in the direction, I, the taping member 102 dispenses the continuous length of tape 220. The outer surface 170 of the second guide member 124 helps direct the continuous length of tape 220 into contact with the container 200 to seal the tape 220 to the container 200. Once a sufficient length of tape 220 is dispensed to the fourth side wall 202*d*, the cutting member 122 cuts the tape 220 to form a discrete length of tape 222 that is adhered to the container 200. Before the cutting member 122 cuts the continuous length of tape 220, vacuum is applied to the continuous length of tape 220 through the vacuum apertures 154 of the first outer surface 150 of the first guide member 120. After the discrete length of tape 222 is cut, the taping member 102 continues to move in the direction, I, in order for the second guide member 124 to apply seal the discrete length of tape 222 to the container 200.

Next, the taping member 102 may advanced in the direction, J, away from the container 200 and the container 200 may advanced in the machine direction MD, away from the taping apparatus 100. The support arm 104 then moves on the track in the direction, H, in preparation for taping a subsequent container.

It is to be appreciated that the taping apparatus 100 may be configured to intermittently tape a container 200 such as shown in FIG. 14. In such an exemplary configuration, the taping apparatus 100 is configured in the second configuration shown in FIG. 2. It is to be appreciated that the method of applying multiple discrete lengths of tape to the container shown in FIG. 14 is similar to the method discussed above with regard to taping the container 200 shown in FIG. 13 except that the taping apparatus 100 is arranged in the second configuration to tape the container 200 shown in FIG. 14.

Figure 19:
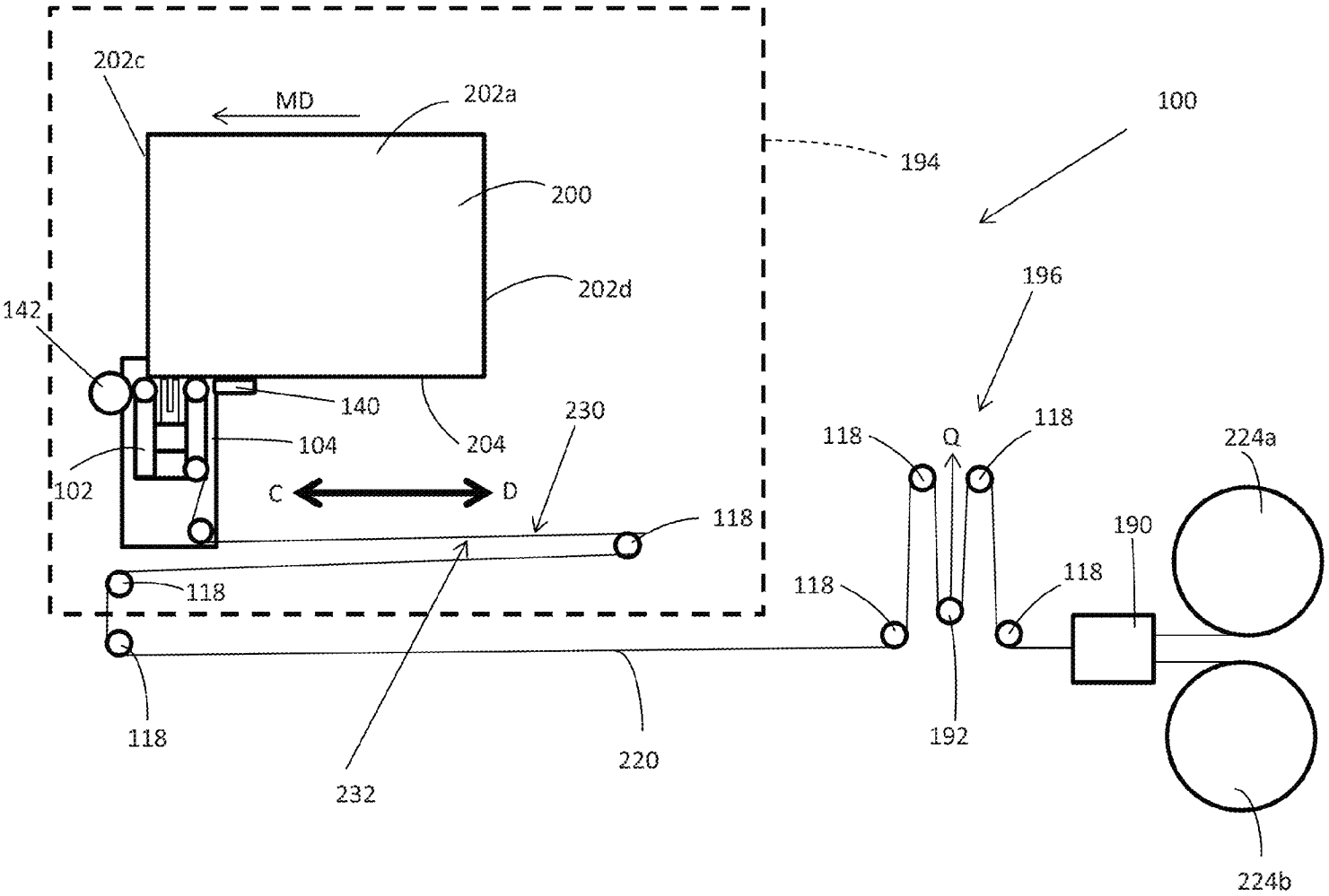
FIG. 19 is a plan view of a taping apparatus having a taping member positioned adjacent to first and second end flaps of a container.
Figure 20:
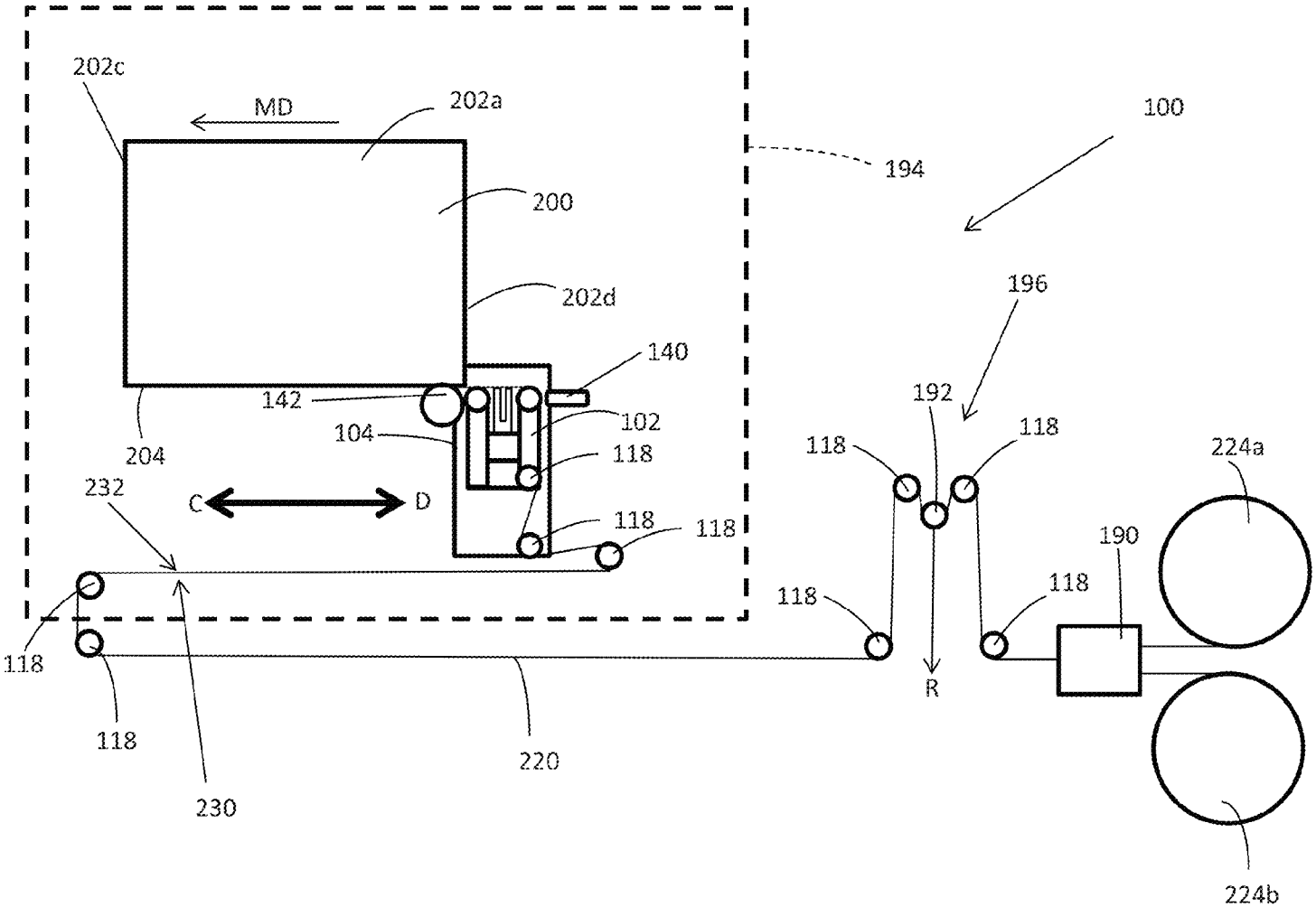
FIG. 20 is a plan view of a taping apparatus having a taping member positioned adjacent to first and second end flaps of a container.

The taping apparatus 100 may be configured to maintain the continuous length of tape 220 with a substantially constant tension as the taping apparatus 100 tapes a container 200. As shown in FIGS. 18 and 19, the taping apparatus 100 may include first and second supply rolls 224*a* and 224*b*, a splicer 190, and an accumulator 196. The accumulator 196 may include a dancer roll 192. Continuous lengths of tape 220 advance from the tape supply roll 224*a* to the splicer 190. When the tape supply roll 224*a* is nearly depleted, the splicer 190 joins the end of the tape from the first tape supply roll 224*a* with the start of the tape from the second tape supply roll 224*b*. From the splicer 190, the continuous length of tape 220 advances to an accumulator 196. The dancer roll 192 of the accumulator 196 is configured to move in directions, Q and R, wherein Q is opposite R. From the accumulator 196, the continuous length of tape 220 advances around the rollers 118 and to the taping member 102.

In operation, with reference to FIGS. 1, 4, and 18-21, as the support arm 104 and the taping member 102 move in the direction, D, the dancer roll 192 moves in the direction, Q. As the support arm 104 and the taping member 102 move in the direction, C, the dancer roll 192 moves in the direction, R. That is, as the taping member 102 moves nearer to the dancer roll 192, the dancer roll 192 releases tape 220 that is accumulated in the accumulator 196 by moving in the direction, Q. Then, as the taping member 102 moves further from the dancer roll 192, the dancer roll 192 moves in the direction, R, to accumulate tape 220. As a result, the continuous length of tape 220 is maintained at a substantially constant tension as the taping apparatus 100 is taping a container 200. This, in turn, may result in a more uniform application of tape 220 to the container 200. Also, maintaining a constant tension in the continuous length of tape 220 may prevent portions of the tape 220 from sticking together, which may prevent the tape 220 from jamming in the taping apparatus 100.

As shown in FIGS. 18-21, the taping apparatus 100 may be partially enclosed by an enclosure 194. The tape supply rolls 224*a* and 224*b*, the splicer 190, the dancer roll 192, and the accumulator 196 may be located outside of the enclosure 194 and the taping member 102, the support arm 104, and the track may be located inside of the enclosure 194.

In some exemplary configurations, with reference to FIGS. 1A, 9B, 11, and 18, a container 200 advances in the machine direction MD such that the slit 216 extends parallel with the machine direction, MD. In such an exemplary configuration, the taping member 102 may be configured to apply a continuous length of tape from the taping member 102 to the third side wall 202*c* of the container 200 while the container 200 is stopped by moving the taping member 102 in a first direction adjacent to the third side wall 202*c* of the container 200. In FIG. 1A, the first direction is shown as direction, B. Direction, B, may be orthogonal to the machine direction MD. The taping member 102 may then apply the continuous length of tape from the taping member 102 to the distal regions 228*a* and 228*b* of the first and second end flaps 208*a* and 208*b* while the container 200 is stopped by moving the taping member 102 in a second direction adjacent to the distal regions 228*a* and 228*b* of the first and second end flaps 208*a* and 208*b* of the container 200. In FIG. 1A, the second direction is shown as direction, D. The direction, D, may be orthogonal to the first direction. Furthermore, the direction, D, may be opposite the machine direction MD. In FIG. 2, the second direction is shown as direction, G. With reference to FIGS. 2, 10B, 12, and 18, in an exemplary configuration where a container 200 advances in the machine direction MD such that the slit 216 extends orthogonal to the machine direction MD, the direction, G, may be orthogonal to the machine direction MD as shown in FIG. 2.

In some exemplary configurations, the taping apparatus 100 may be configured to tape a first container 200*a* advancing in a first orientation such as shown in FIG. 9B and a second container 200*b* advancing in a second orientation such as shown in FIG. 10B. Referring to FIGS. 1A and 9B, the first container 200*a* may advance in a machine direction MD to a taping apparatus 100 and may stop advancing when the first container 200*a* is positioned adjacent to the taping member 102. The taping apparatus 100 may apply a continuous length of tape 220 from the taping member 102 to the third side wall 202*c* of the first container 200*a* while the first container 200*a* is stopped by moving the taping member 102 in a third direction adjacent to the third side wall 202*c* of the first container 200*a*. In FIG. 1A, the third direction is shown as direction, B. The third direction is orthogonal to the first direction. Next, the taping member 102 may apply the continuous length of tape 220 from the taping member 102 to the distal regions 228*a* and 228*b* of the first and second end flaps 208*a* and 208*b* of the first container 200*a* while the first container 200*a* is stopped by moving the taping member 102 in the first direction adjacent to the first and second end flaps 208*a* and 208*b* of the first container 202*a*. In FIG. 1A, the first direction is shown as the direction, D. Then, the taping apparatus 100 may apply the continuous length of tape 220 from the taping member 102 to the fourth side wall 202*d* of the first container 200*a* while the first container 200*a* is stopped by moving the taping member 102 in a fourth direction adjacent to the fourth side wall 202*d* of the first container 200*a*. In FIG. 1A, the fourth direction is shown as the direction, A. The fourth direction is opposite the third direction. The first container 200*a* may advance in the machine direction MD away from the taping apparatus 102.

Next, with reference to FIGS. 2 and 10B, the second container 200*b* may advance in the machine direction MD to the taping apparatus 100 and may stop advancing when the second container 200*b* is positioned adjacent to the taping member 102. The taping apparatus 100 may apply the continuous length of tape 220 from the taping member 102 to the third side wall 202*c* of the second container 200*b* while the second container 200*b* is stopped by moving the taping member 102 in a fifth direction adjacent to the third side wall 202*c* of the second container 200*b*. In FIG. 2, the fifth direction is shown as direction, J. The fifth direction is orthogonal to the second direction. Next, the taping apparatus 100 may apply the continuous length of tape 220 from the taping member 102 to the distal regions 228*a* and 228*b* of the first and second end flaps 208*a* and 208*b* of the second container 200*b* while the second container 200*b* is stopped by moving the taping member 102 in the second direction adjacent to the first and second end flaps 208*a* and 208*b* of the second container 200*b*. In FIG. 2, the second direction is shown as direction, G. Then, the taping apparatus 100 may apply the continuous length of tape 220 from the taping member 102 to the fourth side wall 202*d* of the second container 200*b* while the second container 200*b* is stopped by moving the taping member 102 in the sixth direction adjacent to the fourth side wall 202*d* of the second container 200*b*. In FIG. 2, the sixth direction is shown as the direction, I. The sixth direction is opposite the fifth direction.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of taping containers in different orientations, the method comprising the steps of:

advancing a first container in a machine direction to a taping apparatus, wherein the first container comprises first and second opposing side walls; third and fourth opposing side walls connected with the first and second side walls; a first end flap; and a second end flap, wherein the first and second end flaps each include a proximal region and a distal region, wherein the proximal region of the first end flap is pivotally connected with the first side wall and the proximal region of the second end flap is pivotally connected with the second side wall, wherein a slit extends in a first direction between the first end flap and the second end flap, wherein the taping apparatus comprises a taping member;

stopping the first container from advancing in the machine direction;

applying a continuous length of tape from the taping member to the distal regions of the first and second end flaps of the first container while the first container is stopped by moving the taping member in the first direction adjacent to the first and second end flaps of the first container;

advancing the first container in the machine direction away from the taping apparatus;

advancing a second container in the machine direction to the taping apparatus, wherein the second container comprises first and second opposing side walls; third and fourth opposing side walls connected with the first and second side walls; a first end flap; and a second end flap, wherein the first and second end flaps each include a proximal region and a distal region, wherein the proximal region of the first end flap is pivotally connected with the first side wall and the proximal region of the second end flap is pivotally connected with the second side wall, wherein a slit extends in a second direction between the first end flap and the second end flap, wherein the second direction is orthogonal to the first direction;

re-orienting the taping member after moving the taping member in the first direction so that the taping member can move in the second direction;

stopping the second container from advancing in the machine direction; and applying the continuous length of tape from the taping member to the distal regions of the first and second end flaps of the second container while the second container is stopped by moving the taping member in the second direction adjacent to the first and second end flaps of the second container.

2. The method of claim 1 further comprising the steps of:

applying the continuous length of tape from the taping member to the third side wall of the first container while the first container is stopped prior to the step of applying the continuous length of tape from the taping member to the distal regions of the first and second end flaps of the first container by moving the taping member in a third direction adjacent to the third side wall of the first container, wherein the third direction is orthogonal to the first direction;

applying the continuous length of tape from the taping member to the fourth side wall of the first container while the first container is stopped subsequent to the step of applying the continuous length of tape from the taping member to the distal regions of the first and second end flaps of the first container by moving the taping member in a fourth direction adjacent to the fourth side wall of the first container, wherein the fourth direction is opposite the third direction;

applying the continuous length of tape from the taping member to the third side wall of the second container while the second container is stopped prior to the step of applying the continuous length of tape from the taping member to the distal regions of the first and second end flaps of the second container by moving the taping member in a fifth direction adjacent to the third side wall of the second container, wherein the fifth direction is orthogonal to the second direction; and applying the continuous length of tape from the taping member to the fourth side wall of the second container while the second container is stopped subsequent to the step of applying the continuous length of tape from the taping member to the distal regions of the first and second end flaps of the second container by moving the taping member in a sixth direction adjacent to the fourth side wall of the second container, wherein the sixth direction is opposite the fifth direction.

3. The method of claim 2 further comprising the steps of: cutting the continuous length of tape to form a first discrete length of tape prior to the step of applying the continuous length of tape from the taping member to the third side wall of the second container; and cutting the continuous length of tape to form a second discrete length of tape subsequent to the step of applying the continuous length of tape from the taping member to the fourth side wall of the second container.

* * * * *